US008145081B2

(12) United States Patent
Nishikata

(10) Patent No.: US 8,145,081 B2
(45) Date of Patent: Mar. 27, 2012

(54) IMAGE FORMING APPARATUS AND CONTROL METHOD FOR THE SAME

(75) Inventor: Akinobu Nishikata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 431 days.

(21) Appl. No.: 12/500,271

(22) Filed: Jul. 9, 2009

(65) Prior Publication Data

US 2010/0028035 A1 Feb. 4, 2010

(30) Foreign Application Priority Data

Jul. 30, 2008 (JP) ..... 2008-196849

(51) Int. Cl.
*G03G 15/00* (2006.01)
*G03G 15/20* (2006.01)

(52) U.S. Cl. ..... 399/45; 399/67

(58) Field of Classification Search ..... 399/45, 399/67, 69

See application file for complete search history.

(56) References Cited

U.S. PATENT DOCUMENTS

| | | | | |
|---|---|---|---|---|
| 6,188,868 | B1 | 2/2001 | Shiramura | 399/410 |
| 6,259,887 | B1 * | 7/2001 | Awano | 399/390 |
| 6,421,523 | B1 | 7/2002 | Kondo et al. | 399/404 |
| 6,751,426 | B2 | 6/2004 | Akiba et al. | 399/82 |
| 7,005,619 | B2 | 2/2006 | Fujii et al. | 219/619 |
| 2007/0071528 | A1 * | 3/2007 | Iida et al. | 399/384 |

FOREIGN PATENT DOCUMENTS

| | | |
|---|---|---|
| EP | 1 503 256 A | 2/2005 |
| JP | 8-234620 | 9/1996 |
| JP | 9-80956 | 3/1997 |
| JP | 2005-104063 | 4/2005 |
| JP | 2008-026709 | 2/2008 |

OTHER PUBLICATIONS

Japanese Office Action dated Jan. 14, 2011, issued in Japanese Patent Application No. 2008-196849.

Official Letter/Search Report, issued by the European Patent Office, dated Jan. 13, 2010, in European Application No. 09165595.1.

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

When image forming is to be successively performed on recording sheets having different sizes, an image forming apparatus suitably executes adjustment processing on a fixing apparatus or the like used in the image forming, and maintains image quality as well as suppresses a drop in productivity. To accomplish this, the image forming apparatus specifies the size of a printing material onto which an image is to be performed, and with use of the specified printing material size and the size of printing materials on which images have been formed immediately previously, determines whether it is necessary to execute adjustment processing for maintaining image quality. Specifically, adjustment processing is executed only if the size of the printing material on which an image is to be formed is greater than the size of the printing materials on which images were formed immediately previously.

5 Claims, 37 Drawing Sheets

IMAGE FORMING APPARATUS AND CONTROL METHOD FOR THE SAME

BACKGROUND OF THE INVENTION

1. Field of the Invention

The present invention relates to an image forming apparatus including a function that utilizes a specified area of a recording sheet, on which an image has been formed, as an active portion; and in particular to an image forming apparatus including a function that generates a product by cutting a recording sheet; and to a control method for controlling the function.

2. Description of the Related Art

A conventional image forming apparatus performs heat fixing by, with use of a fixing roller, pressing a toner image that has been transferred onto a recording sheet. In the case of performing printing on both small and large recording sheets, control of the image forming apparatus is required as will be discussed below. For example, as shown in FIG. 43, when small recording sheets are fed in succession, the temperature becomes non-uniform between the center and ends of the fixing roller. When a large recording is fed thereafter, differences in image density occur and a fixing offset (i.e. a non-uniformity in the fixing of the toner image) occurs. FIG. 43 is a diagram showing a fixing temperature distribution after recording sheet (paper) feeding. In FIG. 43, the horizontal axis indicates position on the fixing roller, and the vertical axis indicates the fixing temperature.

As an example of a countermeasure, Japanese Patent Laid-Open No. H08-234620 proposes a low-cost, general method in which the printing operation is temporarily stopped, and fixing adjustment is performed until the temperature of the fixing roller has stabilized. When using the technique disclosed in Japanese Patent Laid-Open No. H08-234620, it is necessary to adjust the temperature of the fixing roller with use of a fixing heater having different light distribution characteristics as shown in FIG. 44. FIG. 44 is a diagram for illustrating the light distribution characteristics of a fixing heater. In FIG. 44, the horizontal axis indicates position on the fixing roller, and the vertical axis indicates the light distribution characteristics.

Also, as shown in FIG. 45, when recording sheets having a large sheet thickness (i.e. are thick) are fed in succession, the end portions of the recording sheets create small flaws (e.g. dents) on the surface of the fixing roller. It is known that when a large recording sheet is fed thereafter, these flawed portions cause small marks to appear in the image on the large recording sheet. FIG. 45 is a diagram showing a condition in which such flaws appear at end portions of thick paper. As a countermeasure, Japanese Patent Laid-Open No. H09-080956 proposes a method of removing flaws from the surface of the fixing roller.

Such fixing temperature adjustment and flaw removal are essential for maintaining image quality, but on the other hand, they are also the cause of a drop in productivity since printing operation is temporarily paused during the fixing temperature adjustment and flaw removal.

With an image forming apparatus such as a copy machine, it is possible to manipulate recording sheets having images formed thereon by connecting a post-processing apparatus to the image forming apparatus. For example, Japanese Patent Laid-Open No. 2005-104063 proposes an image forming apparatus that is configured to perform bookbinding processing by attaching thereto a function for gluing the edge of a paper bundle composed of a plurality of sheets of paper, and a cutting function for cutting sides other than the glued side.

However, the conventional technology described above has the following problems. For example, in the case of performing printing on both small recording sheets and large recording sheets, when there are many switches between small and large recording sheets in the same job, the job has to be paused at each switch in order to perform fixing temperature adjustment and flaw removal.

The following is a more specific description with reference to FIG. 46. FIG. 46 is a diagram showing timings at which fixing adjustment is performed in a job that utilizes different paper sizes. In FIG. 46, the case of performing bookbinding processing with use of an inner sheet bundle and a cover sheet that are different sizes is envisioned. For example, in the envisioned job, a bound book is created by collecting and bundling a plurality of small recording sheets, and then placing a large cover sheet around the bundle. As shown in FIG. 46, in such a case, there is the problem that productivity drops significantly due to the need to perform fixing temperature adjustment and flaw removal before processing of the cover sheet.

SUMMARY OF THE INVENTION

The present invention enables the realization of an image forming apparatus that, when successively performing image forming on recording sheets having different sizes, suitably executes adjustment processing on a fixing apparatus or the like that is used in such image forming, thereby maintaining image quality as well as suppressing a drop in productivity.

One aspect of the present invention provides an image forming apparatus comprising: a transfer unit that transfers a toner image onto a printing material; a fixing unit that fixes the toner image that was transferred by the transfer unit onto the printing material; a cutting unit that executes cutting processing on the printing material onto which the toner image was fixed by the fixing unit; a determination unit that determines whether adjustment processing is to be executed on the fixing unit, based on a post-cutting size of a first printing material to be cut by the cutting unit and the size of a second printing material on which an image was formed immediately before the first printing material; and an adjustment unit that executes the adjustment processing on the fixing unit if the determination unit has determined that the adjustment processing is to be executed on the fixing unit.

Another aspect of the present invention provides a control method for an image forming apparatus that includes a transfer unit that transfers a toner image onto a printing material, a fixing unit that fixes the toner image that was transferred by the transfer unit onto the printing material, and a cutting unit that executes cutting processing on the printing material onto which the toner image was fixed by the fixing unit, the control method comprising: determining whether adjustment processing is to be executed on the fixing unit, based on a post-cutting size of a first printing material to be cut by the cutting unit and the size of a second printing material on which an image was formed immediately before the first printing material; and executing the adjustment processing on the fixing unit if it has been determined in the determining step that the adjustment processing is to be executed on the fixing unit.

Further features of the present invention will be apparent from the following description of exemplary embodiments with reference to the attached drawings.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Overall configuration of image forming system

Figure 1:
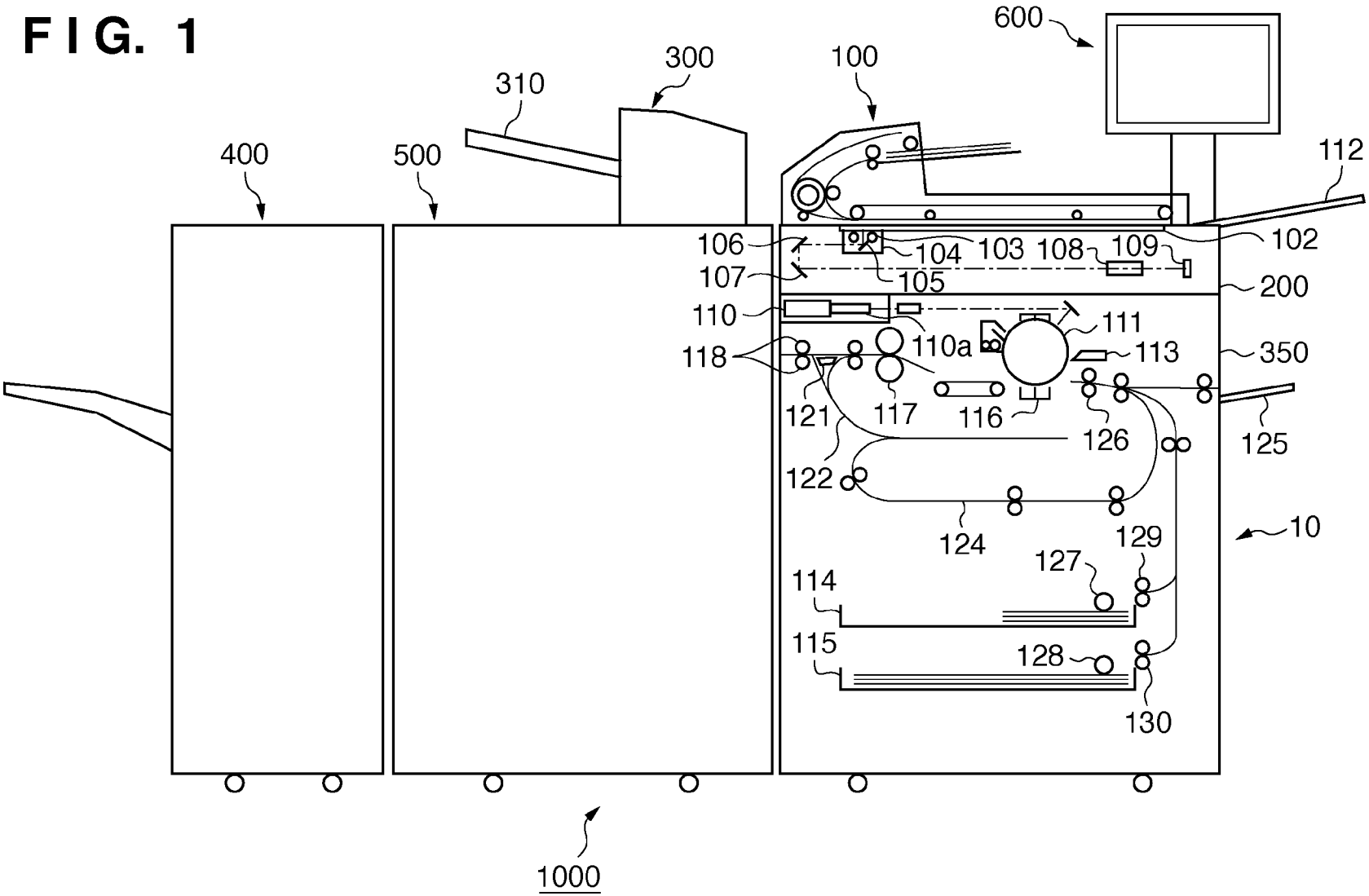
FIG. 1 is a cross-sectional diagram showing an exemplary configuration of an image forming apparatus according to a first embodiment.

First is a description of an overall configuration of an image forming system with reference to FIG. 1. FIG. 1 is a cross-sectional diagram showing an exemplary configuration of an image forming system according to the first embodiment. An image forming system 1000 includes an image forming apparatus 10 and post-processing apparatuses such as a case binding apparatus 500 and a post-processing apparatus 400. The image forming apparatus 10 includes an image reader 200 that reads an image from an original document, and a printer 350 that forms the read image onto paper. Hereinafter, paper onto which images are formed is called printing material, a recording sheet, a sheet, and the like.

A document feeder 100 is installed in the image reader 200. A plurality of originals are set facing upward in an original tray, and the document feeder 100 feeds the originals in the leftward direction in FIG. 1 one at a time in order beginning with the first page, conveys the originals along a curved path and then through a flow reading position from left to right over a platen glass 102. It thereafter discharges the originals toward an external paper receiving tray 112. When an original passes from left to right through the flow reading position over the platen glass 102, an image of the original is read by a scan unit 104 that is held at a position corresponding to the flow reading position. This reading method is generally called an original flow reading method. Specifically, when the original passes through the flow reading position, light from a lamp 103 in the scan unit 104 reflects off of the reading face of the original, and the reflected light from the original is guided to a lens 108 via mirrors 105, 106, and 107. The light that passes through the lens 108 forms an image on an imaging area of an image sensor 109.

In this way, by conveying an original so as to pass through the flow reading position from left to right, original read scanning is performed such that the direction orthogonal to the conveying direction of the original is the main-scanning direction, and the conveying direction is the sub-scanning direction. Specifically, when the original passes through the flow reading position, the entire original image is read by reading the original image line-by-line in the main-scanning direction with use of the image sensor 109 while the original is being conveyed in the sub-scanning direction. The optically read image is converted into image data by the image sensor 109, and the image data is output. The image data output from the image sensor 109 is input as a video signal to an exposure control unit 110 of the printer 350.

Note that the original can also be read as a result of the document feeder 100 conveying the original onto the platen glass 102, causing the original to stop at a predetermined position, and causing the scan unit 104 to scan the original from left to right in this state. This reading method is generally called original stationary reading.

When reading an original without use of the document feeder 100, first a user lifts up the document feeder 100, places the original onto the platen glass 102, and then causes the scan unit 104 to scan the original from left to right, as a result of which original reading is performed. In other words, when reading an original without use of the document feeder 100, original stationary reading is performed.

The exposure control unit 110 of the printer 350 modulates a laser beam based on the video signal input from the image reader 200, and outputs the modulated laser beam. The laser beam is irradiated onto a photosensitive drum 111 while being scanned with use of a polygon mirror 110*a*. An electrostatic latent image is formed on the photosensitive drum 111 according to the scanned laser beam. Here, the exposure control unit 110 outputs the laser beam so that a correct image (not a mirror image) will be formed during original stationary reading. The electrostatic latent image on the photosensitive drum 111 is visualized as a developer image by developer supplied from a developing unit 113.

Meanwhile, a sheet fed by pickup rollers 127 and 128 from an upper cassette 114 or a lower cassette 115 built into the printer 350 is conveyed to a resist roller 126 by paper feeding rollers 129 and 130. When the front edge of the sheet has reached the resist roller 126, the resist roller 126 is driven at a controlled timing and the sheet is conveyed between the photosensitive drum 111 and a transfer unit 116 in synchronization with a start of irradiation of the laser beam. The developer image formed on the photosensitive drum 111 is transferred to the fed sheet by the transfer unit 116. The sheet onto which the developer image has been transferred is conveyed to a fixing unit 117, and the fixing unit 117 fixes the developer image onto the sheet by applying heat and pressure to the sheet. After passing through the fixing unit 117, the sheet is discharged from the printer 350 to the exterior of the image forming apparatus (in this case, to the case binding apparatus 500) via a flapper 121 and a discharge roller 118.

Here, if the sheet is to be discharged in a state where the image forming face is facing downward (face-down), after passing through the fixing unit 117, the sheet is temporarily guided to an inversion path 122 by a switch operation of the flapper 121. Furthermore, after the back edge of the sheet has passed through the flapper 121, the sheet is switched back and discharged from the printer 350 by the discharge roller 118. This form of paper discharging is called inverted paper discharging. Inverted paper discharging is performed when image forming is to be performed in order beginning with the first page, such as when forming an image read with use of the document feeder 100, or when forming an image that has been output from a computer, and as a result, the discharged sheets are in the correct page order.

Also, in the case of image formation on a stiff sheet such as an overhead projector sheet from a manual feeding unit 125, the sheet is not guided to the inversion path 122, but rather is discharged by the discharge roller 118 in a state in which the image forming face is facing upward (face-up). Furthermore, in the case where double-sided formation has been set in which image forming is performed on both sides of a sheet, the sheet is guided to the inversion path 122 by the switch operation of the flapper 121, and thereafter conveyed to a double-sided conveying path 124. After being guided to the double-sided conveying path 124, control is performed such that the sheet is again fed between the photosensitive drum 111 and the transfer unit 116 at the timing described above in order to print on the reverse side of the sheet.

Case Binding Apparatus Configuration

Figure 2:
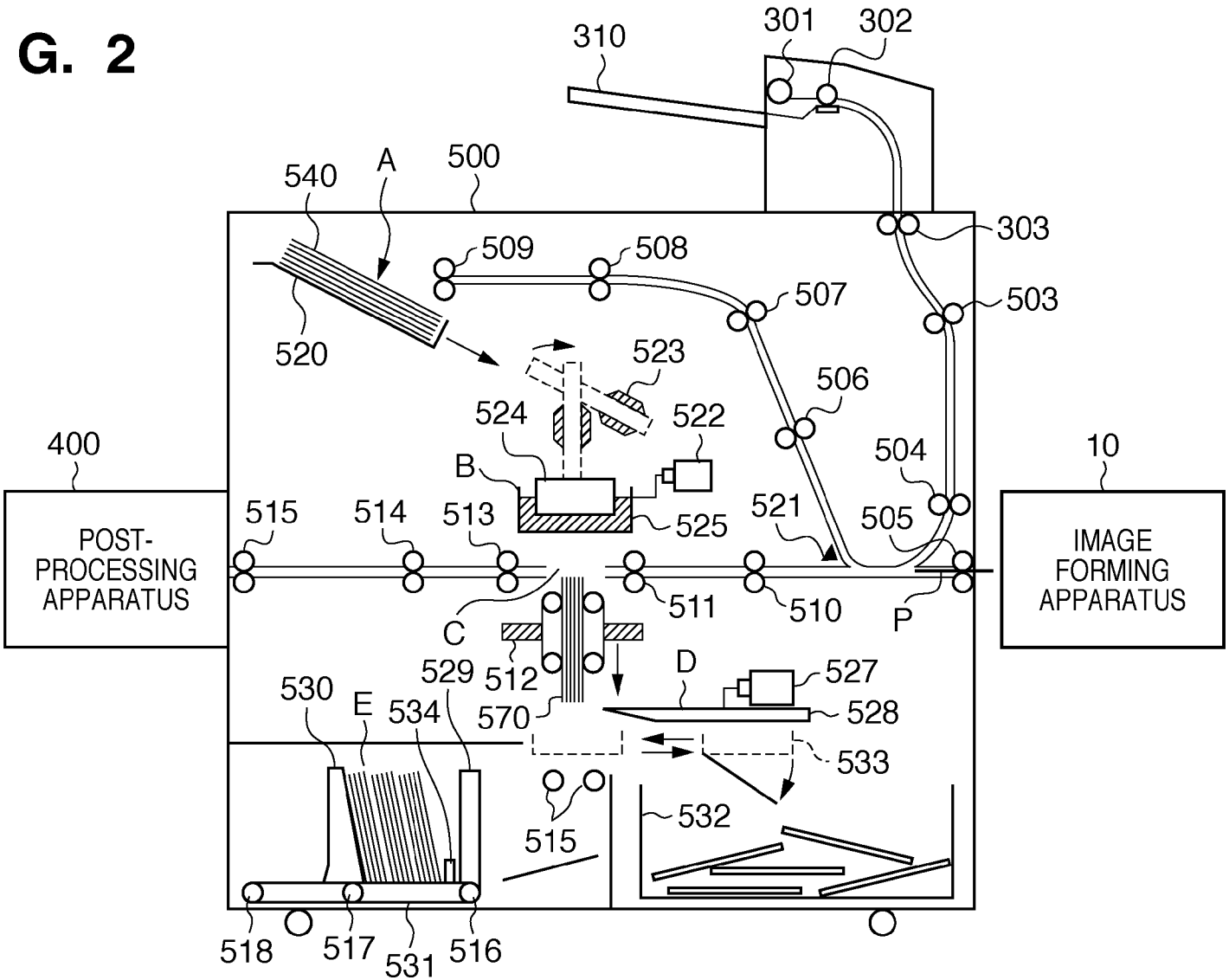
FIG. 2 is a cross-sectional diagram showing an exemplary configuration of a case binding apparatus according to the first embodiment.

Next is a description of a configuration of the case binding apparatus with reference to FIG. 2. FIG. 2 is a cross-sectional diagram showing an exemplary configuration of the case binding apparatus according to the first embodiment.

The case binding apparatus 500 includes a sheet stacking unit A, a gluing unit B, an adhesion unit C, a cutting unit D, and a bookbinding discharge unit E. In the bookbinding mode, the sheet stacking unit A stacks recording sheets discharged from the image forming apparatus 10, and creates a sheet bundle. The gluing unit B applies glue to the stacked bundle. The adhesion unit C adheres a cover sheet to the stacked bundle to which glue has been applied. In order to align the bookbinding end face after adhesion of the cover sheet, the cutting unit D performs cutting in three directions on sides other than the glued side. The bookbinding discharge unit E discharges a completed bound book.

The following describes the flow of a series of bookbinding operations. Note that this description is merely an overview of the series of bookbinding operations, and details of the various units will be described later.

In the bookbinding mode, the sheet stacking unit A stacks recording sheets discharged from the image forming apparatus 10 into a sheet stacking tray 520, and creates a sheet bundle 540. The sheet bundle 540 that has been bundled by the sheet stacking unit A is moved to the gluing unit B, and a lower lateral face and/or end and/or side of the sheet bundle is coated with glue with use of a glue container 525, a glue coating roller 524, and a glue coating roller control motor 522. The adhesion unit C adheres a cover sheet P discharged from the image forming apparatus 10 to the sheet bundle 540 to which glue has been applied, and passes a book 570 to a trim gripper 512. The book 570 is then conveyed to the cutting unit D by the trim gripper 512. In the cutting unit D, a cutter control motor 527 moves a cutter 528 in the horizontal direction, thereby cutting the book 570. Scraps resulting from the cutting fall into a cutting scrap receptacle 533, and the cutting scraps are collected in a cutting scrap box 532 when the series of cutting operations has ended. After cutting in the cutting unit D has ended, the book 570 is conveyed from the cutting unit D to the bookbinding discharge unit E, and the book 570 is discharged.

Although the above is the flow of a series of bookbinding operations in the bookbinding mode, it is also possible to select a normal discharge mode in which bookbinding is not performed, as an alternative to the bookbinding mode.

A switch flapper 521 is disposed downstream of a conveying roller pair 505. The switch flapper 521 is a flapper for selectively guiding sheets that have been sent from the conveying roller pair 505 to the sheet stacking tray 520 or the post-processing apparatus 400.

In the normal mode, a sheet P that has been discharged from the image forming apparatus 10 is discharged to the post-processing apparatus 400 with use of conveying roller pairs 505, 510, 511, 513, and 514, and a discharge roller 515. An example of the post-processing apparatus is a sheet post-processing apparatus that is connected as a downstream apparatus of the bookbinding device, such as the post-processing apparatus 400, and the post-processing apparatus can perform, for example, manipulation of bundles, that is to say, bundle discharge processing, stapling processing, folding processing, bookbinding processing, and the like.

Also, in the bookbinding mode, sheets P that that have been discharged from the image forming apparatus 10 are discharged to the sheet stacking tray 520 via conveying roller pairs 506, 507, and 508, and a stacking unit discharge roller 509, and thereafter the sheets are aligned and formed into the sheet bundle 540.

Sheet stacking unit A operations

Figure 23:
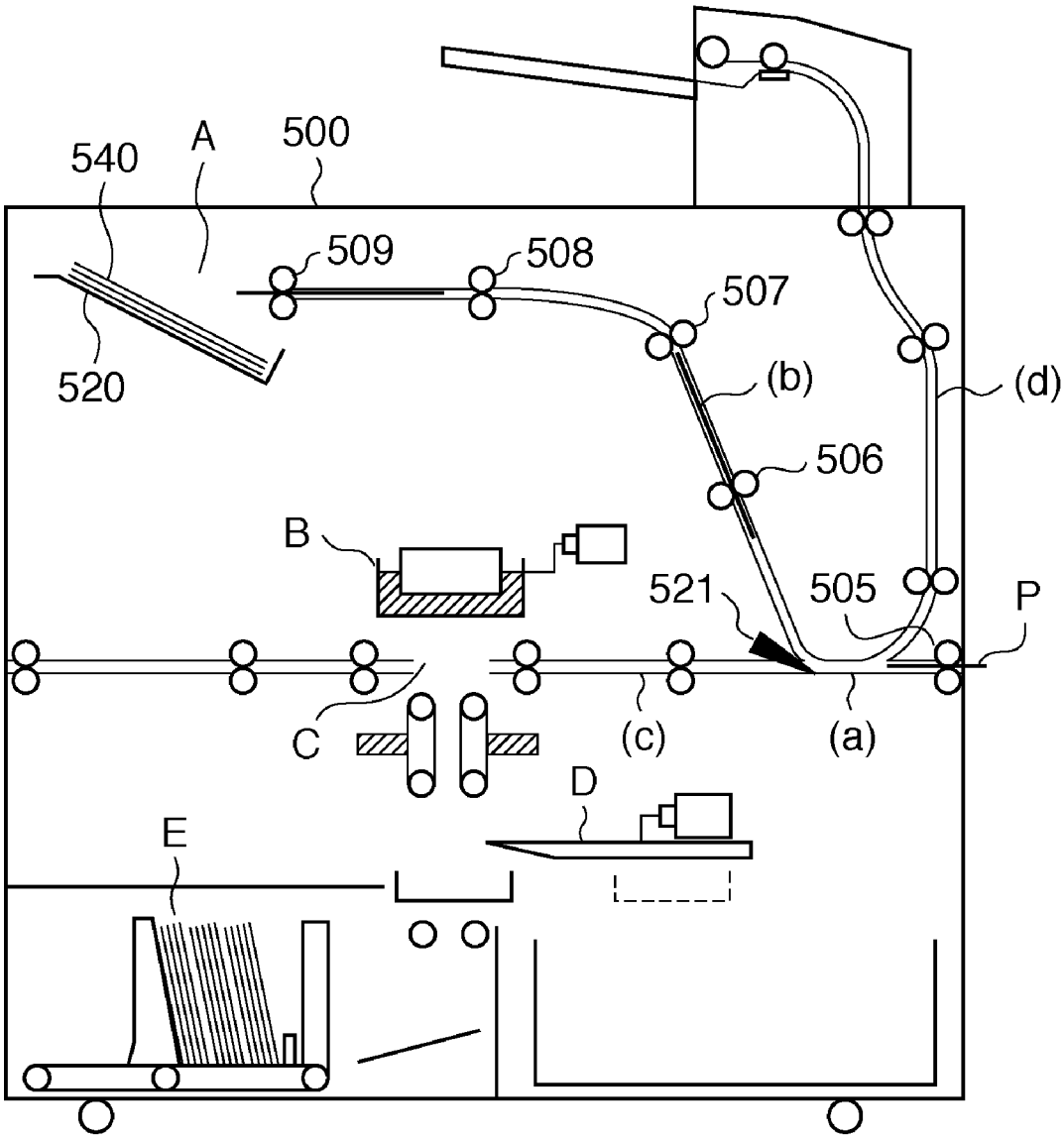
FIG. 23 is a diagram for illustrating a flow of inner sheets in the case binding apparatus.
Figure 24:
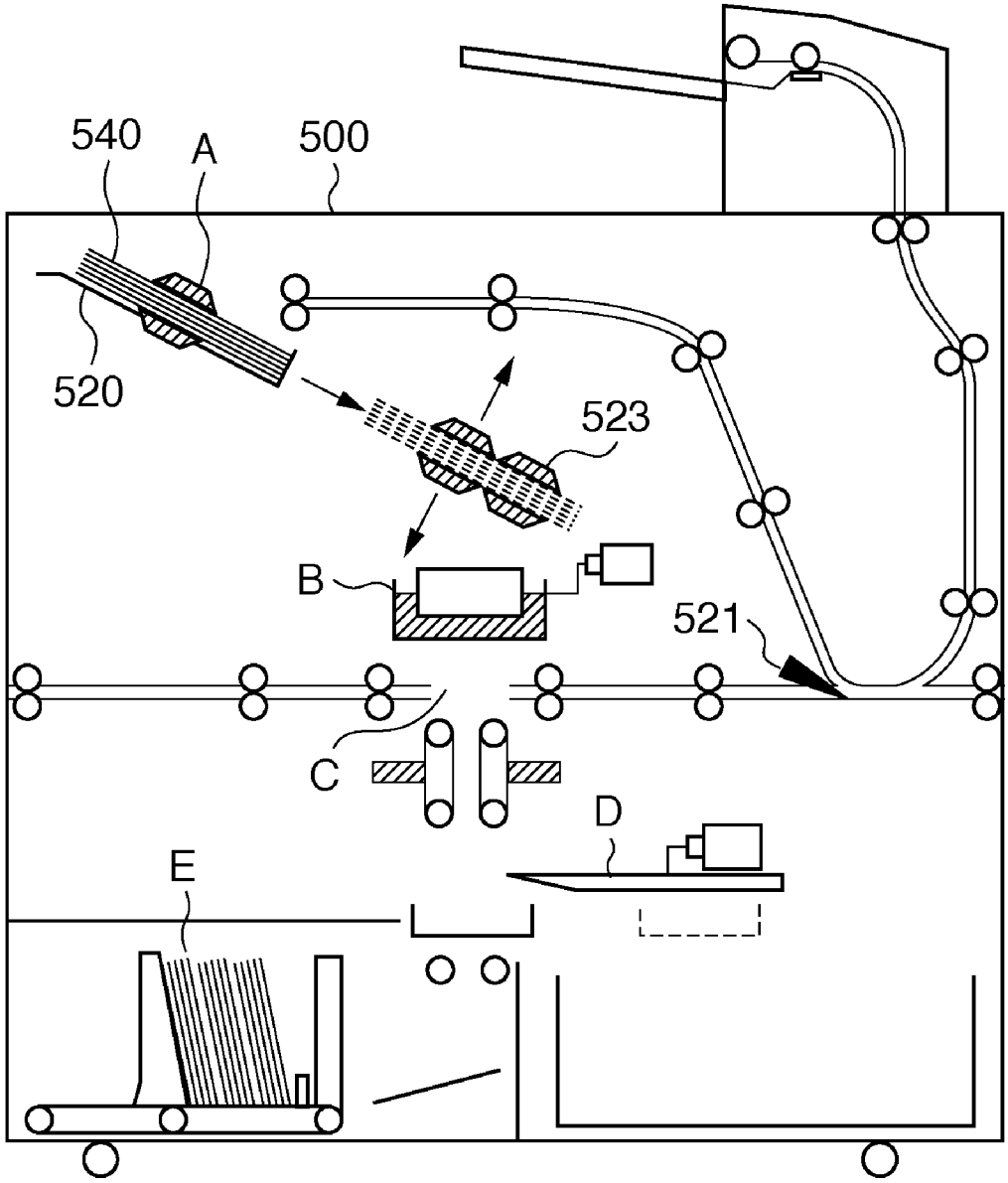
FIG. 24 is a diagram for illustrating a flow of inner sheets in the case binding apparatus.
Figure 25:
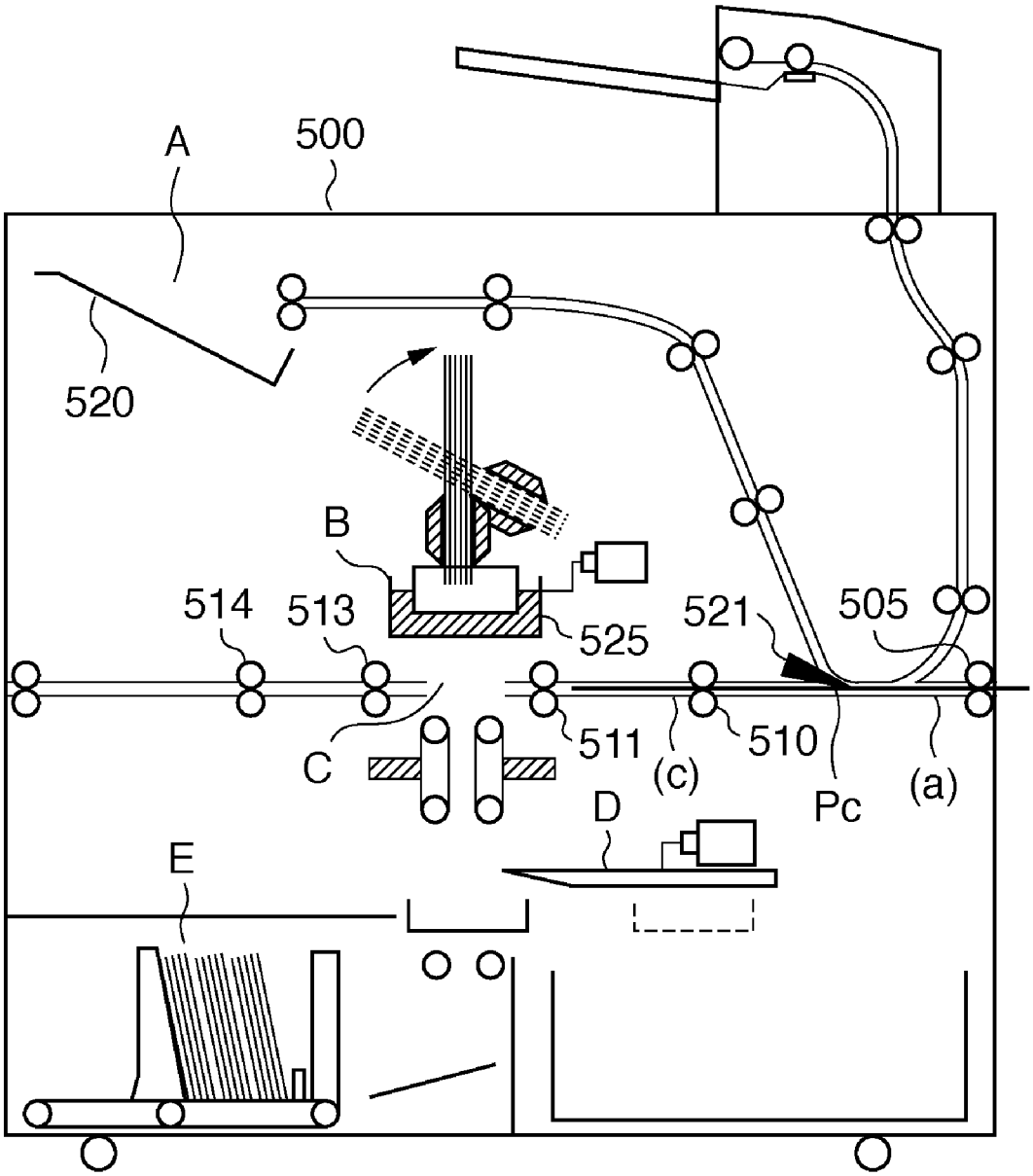
FIG. 25 is a diagram for illustrating a flow of inner sheets and cover sheets in the case binding apparatus.
Figure 26:
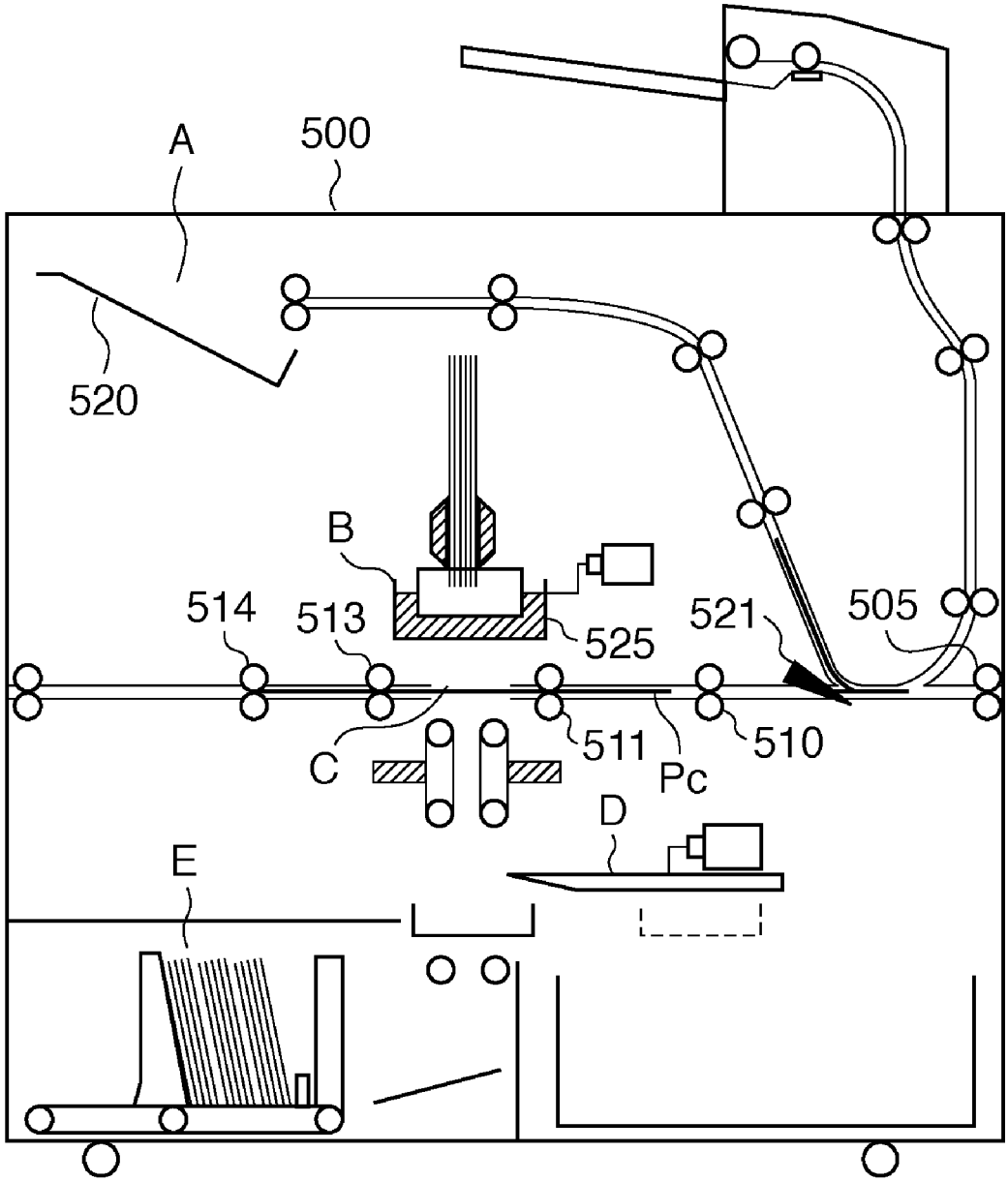
FIG. 26 is a diagram for illustrating a flow of inner sheets and cover sheets in the case binding apparatus.

The following describes operations performed by the sheet stacking unit A in the case binding apparatus 500 with reference to FIGS. 23 to 26. FIGS. 23 and 24 are diagrams for illustrating a flow of inner sheets in the case binding apparatus. FIGS. 25 and 26 are diagrams for illustrating a flow of inner sheets and cover sheets in the case binding apparatus.

As shown in FIG. 23, the case binding apparatus 500 takes in sheets discharged from the image forming apparatus 10 with use of the conveying roller pair 505, and guides the sheets to a conveying path (a). If the sheets are inner sheets of a sheet bundle, the sheets taken in by the conveying roller pair 505 are guided to a conveying path (b) by the switch flapper 521, and conveyed by the conveying rollers pairs 506, 507, and 508, and the stacking unit discharge roller 509. The sheets P are discharged from the stacking unit discharge roller 509 to the sheet stacking tray 520. When all of the sheets that are to be inner sheets have been discharged to the sheet stacking tray 520, the sheet bundle 540 formed from inner sheets is gripped by a gluing gripper 523 and moved from the sheet stacking unit A to a position above the gluing unit B, as shown by the dashed lines in FIG. 24.

After being moved to the position above the gluing unit B, as shown in FIG. 25, the bundle of inner sheets is rotated so as to be vertical while being gripped by the gluing gripper 523, such that a lateral face (i.e. the bottom end) that is to be the spine of the sheet bundle is at a position opposing the gluing unit B. Thereafter, the glue container 525 and glue coating roller 524 move along the sheet bundle, thereby applying glue to an end portion of the sheet bundle, and details of this operation are described later. Meanwhile, a cover sheet Pc that is to be the cover sheet of the book is discharged from the image forming apparatus 10 and conveyed to the case binding apparatus 500. After the cover sheet Pc has been taken in by the conveying roller pair 505, the switch flapper 521 is switched, and the cover sheet Pc is guided from the conveying path (a) to a conveying path (c) and conveyed by the conveying roller pairs 510, 511, 513, and 514. A sensor (not shown) is provided on the conveying path (c) downstream of the conveying roller pair 513, and as shown in FIG. 26, when the front end of the cover sheet Pc has been detected by the sensor, the cover sheet Pc is conveyed a predetermined distance, and thereafter the conveying of the cover sheet Pc is stopped.

The configuration is such that when the cover sheet Pc is stopped on the conveying path (c), the back end of the cover sheet Pc has completely passed the switch flapper 521. In the case of creating sheet bundles in succession, the switch flapper 521 is switched even while the cover sheet Pc is on the conveying path (c). Inner sheets for the next sheet bundle are then received from the image forming apparatus 10, and are conveyed to the sheet stacking tray 520 via the conveying path (a) and the conveying path (b). Thereafter, the sheet bundle is coated with glue, a cover sheet is wrapped around the sheet bundle, and the sheet bundle is conveyed downstream, and details of these operations are described later.

Although the case in which a cover sheet is conveyed from the image forming apparatus 10 is described above, an inserter 300 (shown in FIG. 1) may be provided on an upper portion of the case binding apparatus 500, and it is possible for only the cover sheet to be inserted from the inserter 300.

Figure 27:
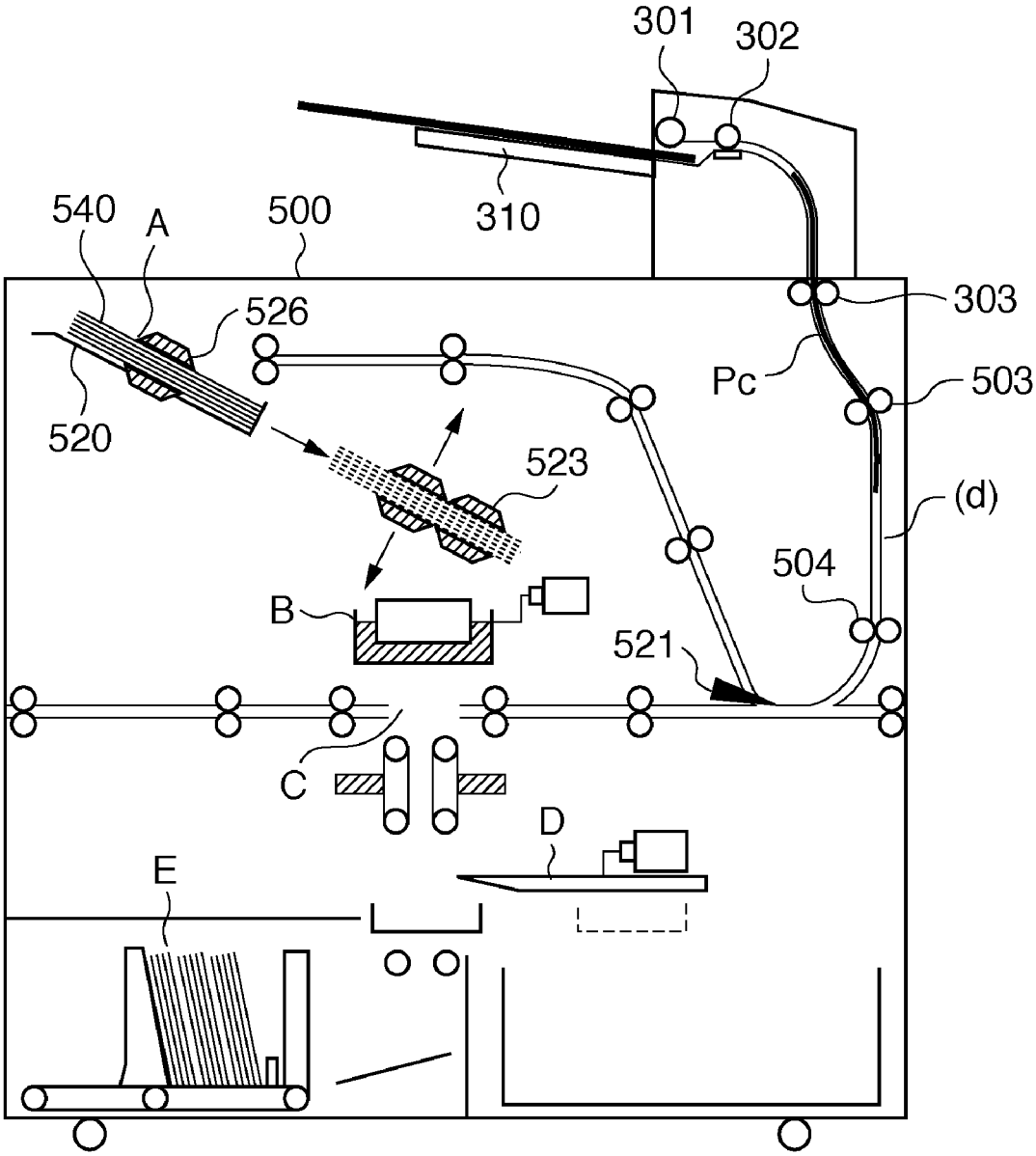
FIG. 27 is a diagram for illustrating a flow of a cover sheet that has been inserted from an inserter in the case binding apparatus.
Figure 28:
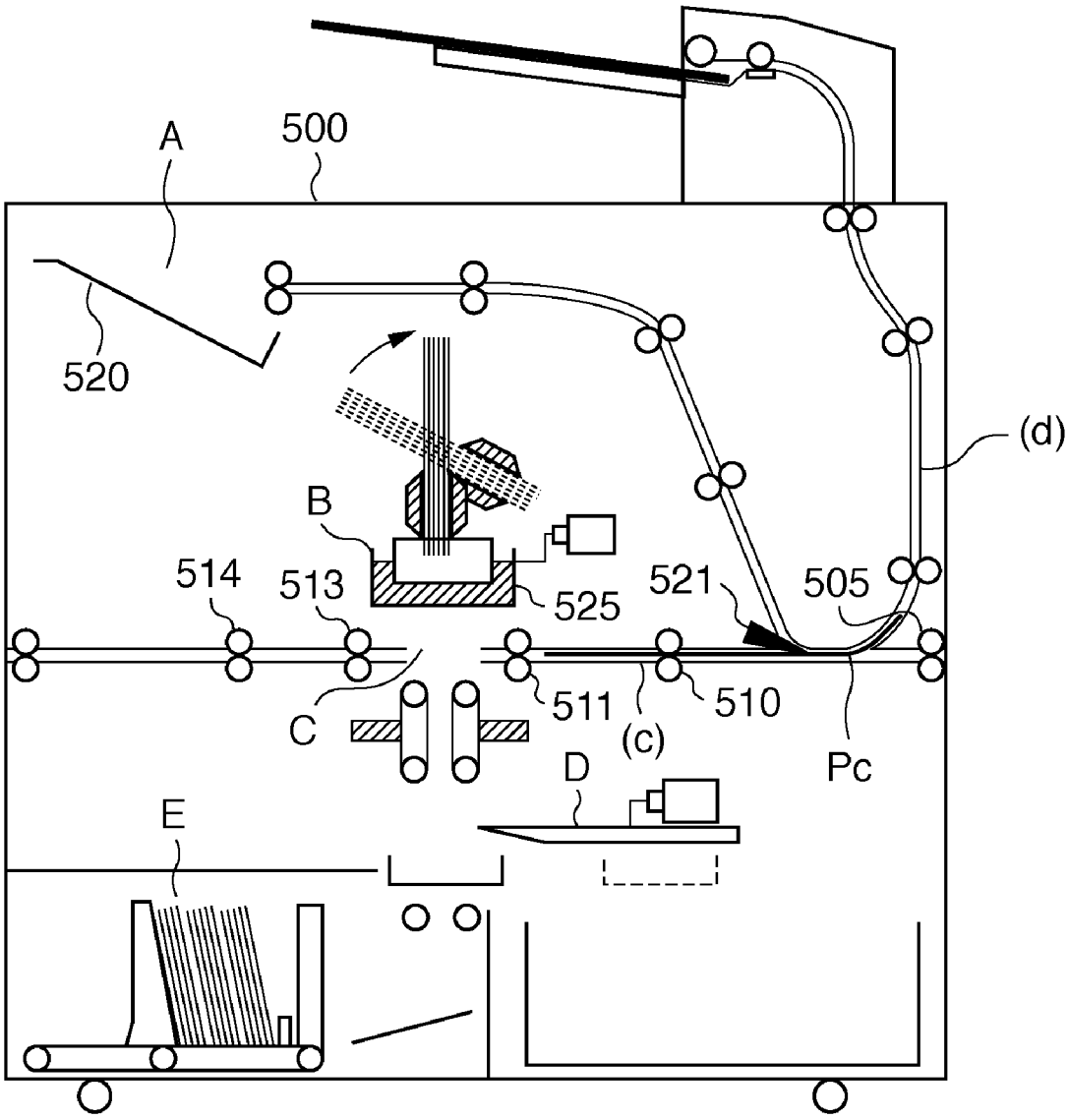
FIG. 28 is a diagram for illustrating a flow of the cover sheet that has been inserted from an inserter in the case binding apparatus.

The following describes a flow of paper in the case of performing bookbinding in which the cover sheet is inserted from the inserter 300, with reference to FIGS. 27 and 28. FIGS. 27 and 28 are diagrams for illustrating a flow of a cover sheet that has been inserted from the inserter in the case binding apparatus.

Regarding the flow of inner sheets, as described above with reference to FIGS. 23 to 26, the image forming apparatus 10 sequentially receives sheets, a sheet bundle is created by the sheet stacking tray 520, and each bundle is moved to the gluing unit B by the gluing gripper 523. However, in the case where the cover sheet Pc is inserted from the inserter 300, as shown in FIG. 27, while the bundle of inner sheets is being moved to the gluing unit B, a paper feeding roller 301 feeds one top sheet from a paper feeding tray 310, and the fed cover sheet Pc is conveyed by conveying roller pairs 303, 503, and 504. Then, as shown in FIG. 28, the cover sheet Pc is guided from a conveying path (d) to the conveying path (c) by the switch flapper 521.

Gluing Unit B Operations

Figure 3:
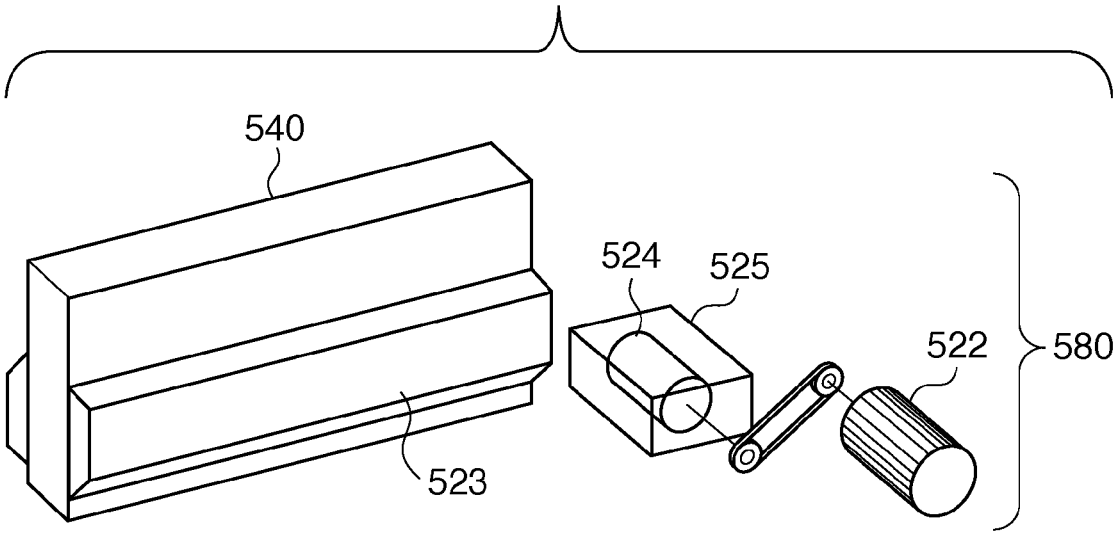
FIG. 3 is a diagram showing an exemplary configuration of a gluing unit B.
Figure 4:
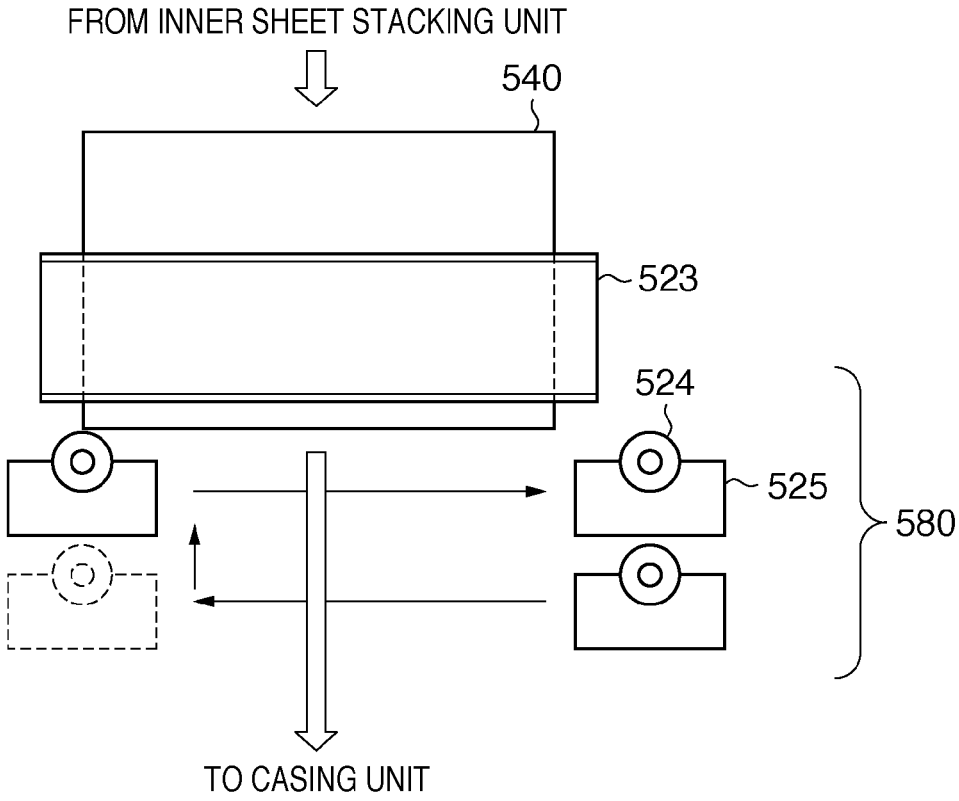
FIG. 4 is a diagram showing an overview of a gluing operation performed by the gluing unit B.

The following describes operations performed by the gluing unit B of the case binding apparatus 500 with reference to FIGS. 3 and 4. FIG. 3 is a diagram showing an exemplary configuration of the gluing unit B. FIG. 4 is a diagram showing an overview of a gluing operation performed by the gluing unit B. The gluing unit B includes the gluing gripper 523 that grips a sheet bundle 540, the glue container 525 that stores glue, the glue coating roller 524 that coats the sheet bundle with glue, and the glue coating roller control motor 522.

The glue coating roller 524 is immersed in the glue container 525 and is in a state of constant rotation due to the rotation of the glue coating roller control motor 522. A gluing unit 580 that includes the glue container 525, glue coating roller 524, and glue coating roller control motor 522 is moved, by a driving unit that is not shown, in the longitudinal direction of the lower lateral face (end) of the sheet bundle 540 that is gripped in an upright state by the gluing gripper 523, that is to say, in a direction parallel to the sheets in the sheet bundle. The coating of the glue is performed by a reciprocating operation of the gluing unit. As shown in FIG. 4, the gluing unit 580 begins moving from an initial position toward the back side of the case binding apparatus 500 (if FIG. 2 is viewed from the front (or indeed the back) of the case binding apparatus 500), and stops at a predetermined position toward the front side of the case binding apparatus 500. At this time, the gluing unit 580 does not apply glue to the lower lateral face of the sheet bundle. The application of glue to the sheet bundle is performed when moving from the front side of the case binding apparatus 500 to the back side. After stopping at the predetermined position toward the front side of the case binding apparatus 500, the gluing unit 580 rises to a position such that the glue coating roller 524 comes into contact with the lower lateral face of the sheet bundle. The gluing unit 580 then coats the lower lateral face of the sheet bundle 540 with glue with use of the glue coating roller 524 while moving from the front side of the case binding apparatus 500 to the back side.

Adhesion Unit C Operations

Figure 5:
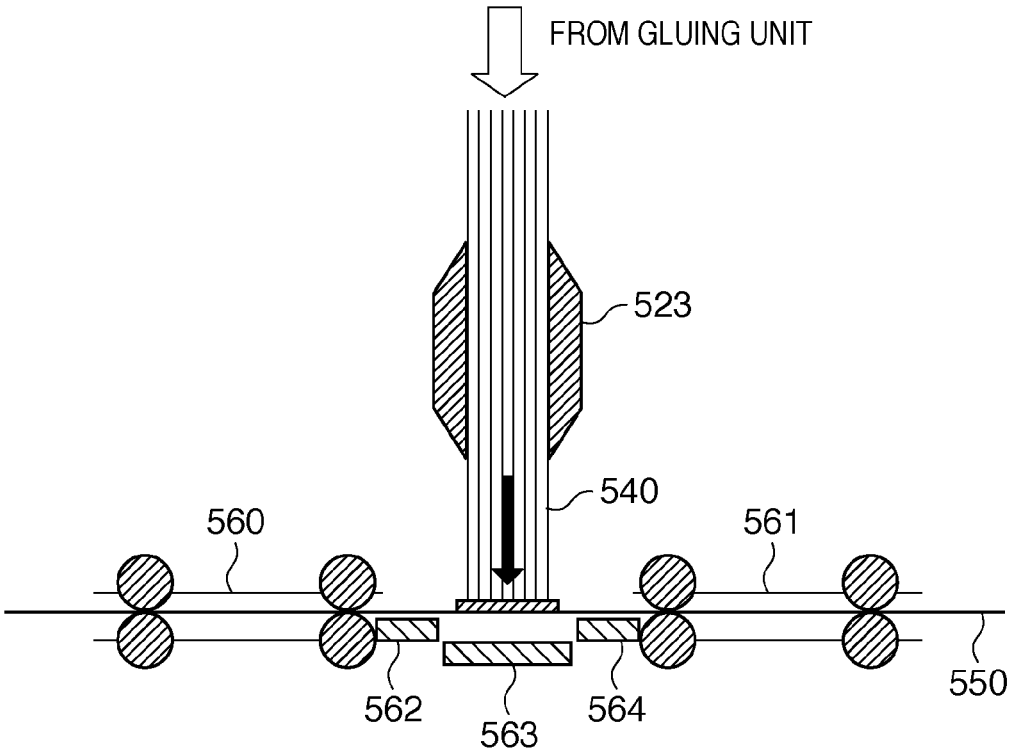
FIG. 5 is a cross-sectional diagram showing an exemplary configuration of an adhesion unit C.

The following describes operations performed by the adhesion unit C with reference to FIGS. 5 to 12. FIG. 5 is a cross-sectional diagram showing an exemplary configuration of the adhesion unit C. The adhesion unit C includes conveying guides 560 and 561, a pressing member 563, and folding members 562 and 564. The conveying guides 560 and 561 receive a cover sheet 550 supplied from the image forming apparatus 10, convey the cover sheet 550, and stop the cover sheet 550 at a predetermined position. The pressing member 563 presses the cover sheet 550 onto the glue-coated face of the sheet bundle 540. The folding members 562 and 564 are used when wrapping the cover sheet around the sheet bundle.

When the operation for applying glue to the sheet bundle 540 has ended, a driving unit (not shown) causes the gluing gripper 523 that is gripping the sheet bundle 540 to descend from the gluing unit B. Then, as shown in FIG. 5, the glue-coated face is adhered to the cover sheet 550 that has been moved horizontally to the predetermined position by the conveying guides 560 and 561.

Figure 6:
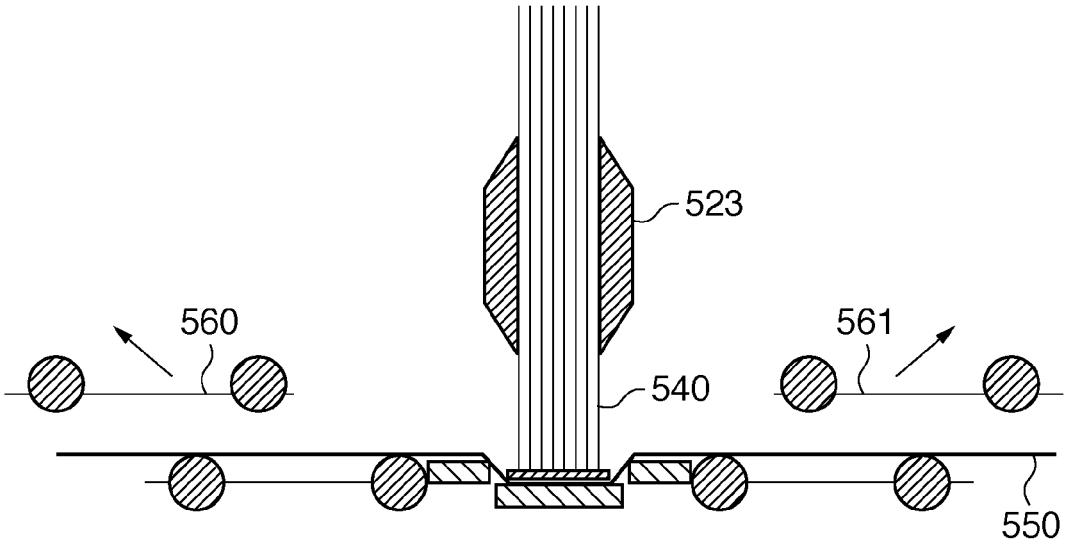
FIG. 6 is a diagram showing a condition in which top parts of conveying guides have been moved away in the adhesion unit C.

After adhesion, the gluing gripper 523 descends, and an adhesion portion of the cover sheet 550 placed on the pressing member 563 is pressed against and adhered to the glue-coated face of the sheet bundle 540. It should be noted that, as shown in FIG. 6, before the cover sheet 550 is pressed against the glue-coated face due to the descending of the sheet bundle 540, it is desirable to move the top part of the conveying guide 560 and the top part of the conveying guide 561 in order to prevent interference with the sheet bundle 540. FIG. 6 is a diagram showing a condition in which the top parts of conveying guides have been moved away in the adhesion unit C.

Figure 7:
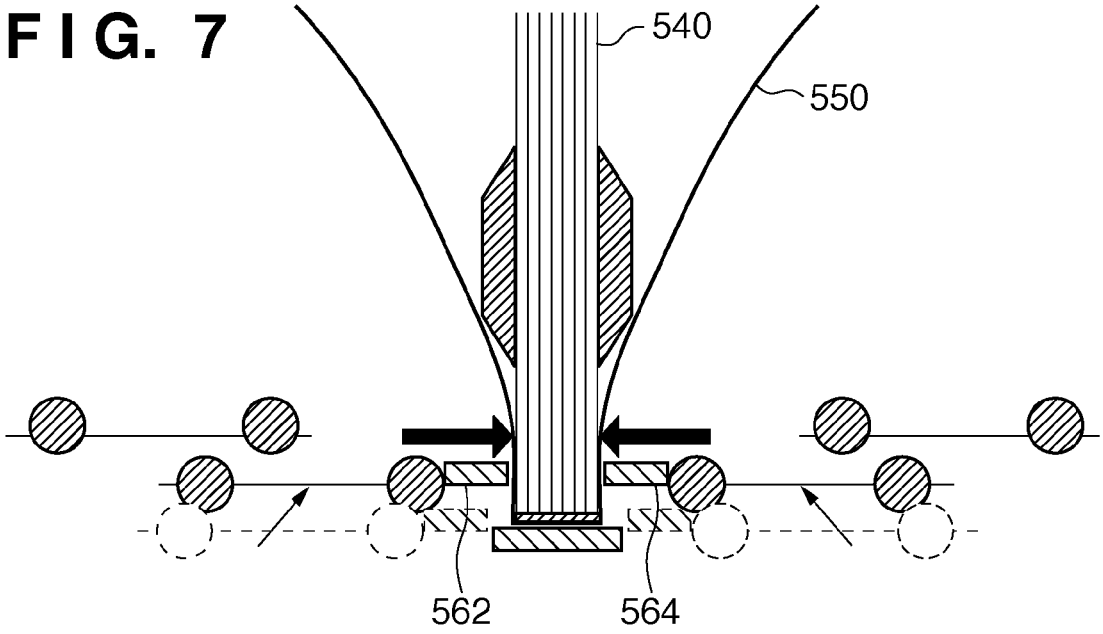
FIG. 7 is a diagram showing a condition in which bottom parts of the conveying guides are being moved in the adhesion unit C.

After the cover sheet 550 has been adhered to the sheet bundle 540, a driving unit causes the folding members 562 and 564, and the bottom parts of the conveying guides 560 and 561 to rise in an oblique direction above the pressing member 563, and as shown in FIG. 7, these elements move from the broken line positions to the solid line positions. FIG. 7 is a diagram showing a condition in which the bottom parts of the conveying guides are being moved in the adhesion unit C. The cover sheet 550 is pressed upward by the rising of the folding members 562 and 564 in the upward oblique direction. As a result, the cover sheet 550 is bent from the lateral edges of the glue-coated face, and thus casing processing for wrapping the cover sheet 550 around the sheet bundle 540 is performed.

Figure 8:
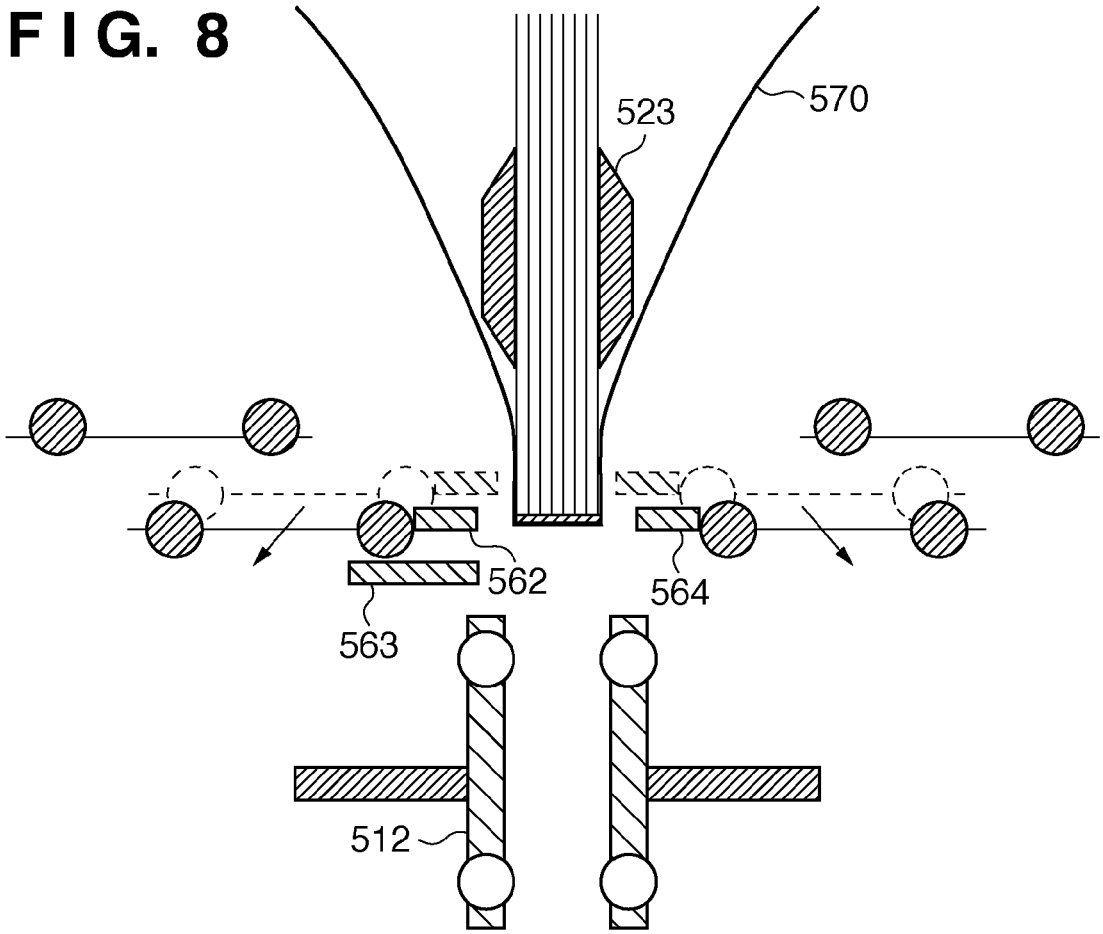
FIG. 8 is a diagram showing a condition in which the bottom parts of the conveying guides are being moved in the adhesion unit C.

When the cover sheet 550 casing processing has ended, as shown in FIG. 8, a driving unit causes the folding members 562 and 564, and the bottom parts of the conveying guides 560 and 561 to move away, from the broken line positions to the solid line positions. FIG. 8 is a diagram showing a condition in which the bottom parts of the conveying guides are being moved in the adhesion unit C. At the same time, the pressing member 563 is also moved in the horizontal direction by a driving unit. Moving the pressing member 563 horizontally retains a space through which the gluing gripper 523 causes the book 570 to descend.

Figure 9:
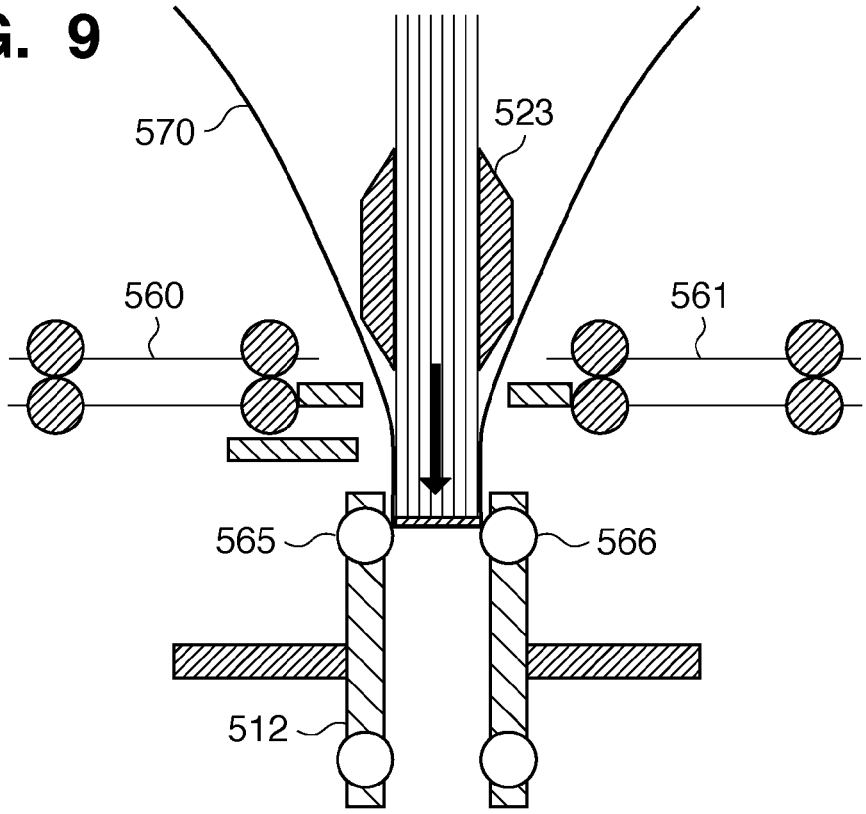
FIG. 9 is a diagram showing a condition in which a gluing gripper is descending in the adhesion unit C.

As shown in FIG. 9, after the gluing gripper 523 has caused the book 570 to descend below the conveying guides 560 and 561, the book 570 further descends to a position such that the bottom end of the book 570 comes into contact with trim unit delivery rollers 565 and 566. FIG. 9 is a diagram showing a condition in which the gluing gripper is descending in the adhesion unit C.

Figure 10:
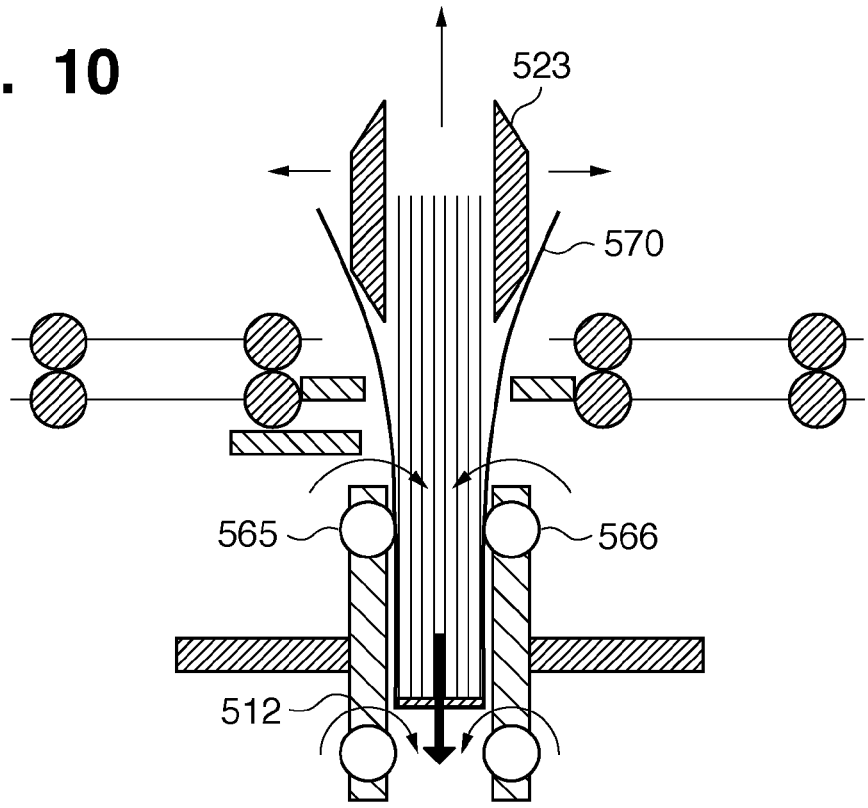
FIG. 10 is a diagram showing a condition in which the gluing gripper releases a book in the adhesion unit C.

Next, as shown in FIG. 10, the gluing gripper 523 releases its grip on the book 570, and at the same time, the trim unit delivery rollers 565 and 566 convey the book 570 downward. FIG. 10 is a diagram showing a condition in which the gluing gripper releases the book in the adhesion unit C.

Figure 11:
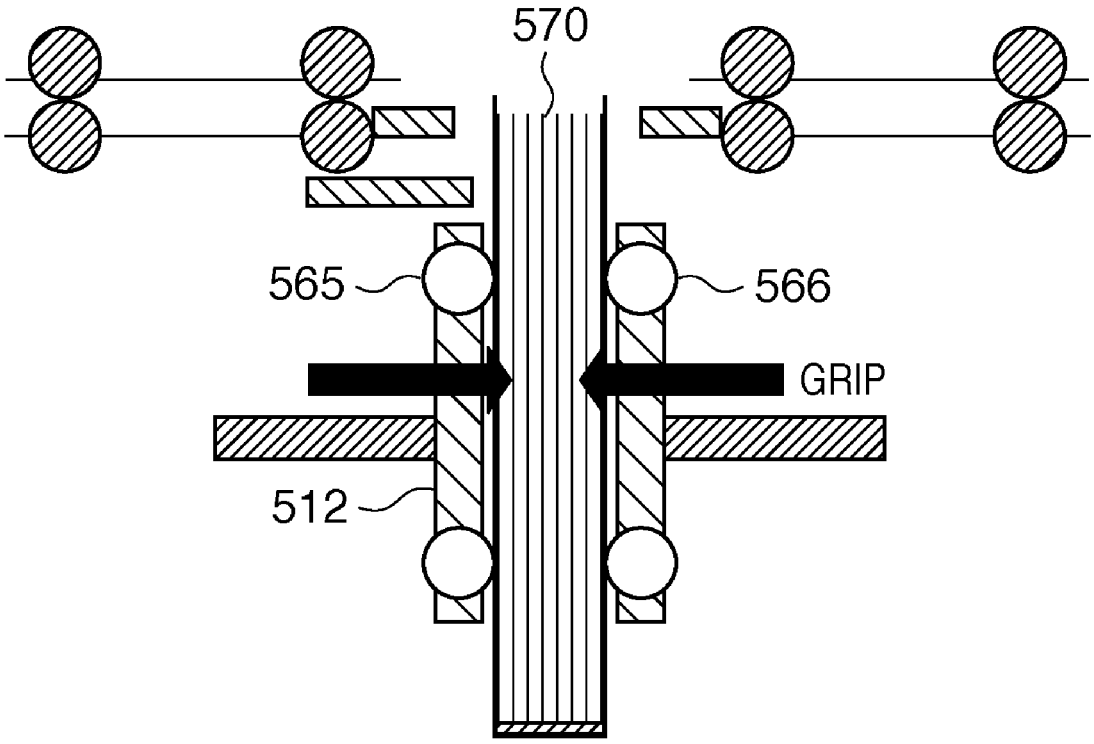
FIG. 11 is a diagram showing a condition in which a trim gripper grips the book in the adhesion unit C.

Next, as shown in FIG. 11, the book 570 is conveyed downward to a predetermined position by the trim unit delivery rollers 565 and 566, and thereafter the conveying of the book 570 is stopped. Thereafter, a driving unit (not shown) causes the trim gripper 512 to grip the book 570. FIG. 11 is a diagram showing a condition in which the trim gripper grips the book in the adhesion unit C.

Figure 12:
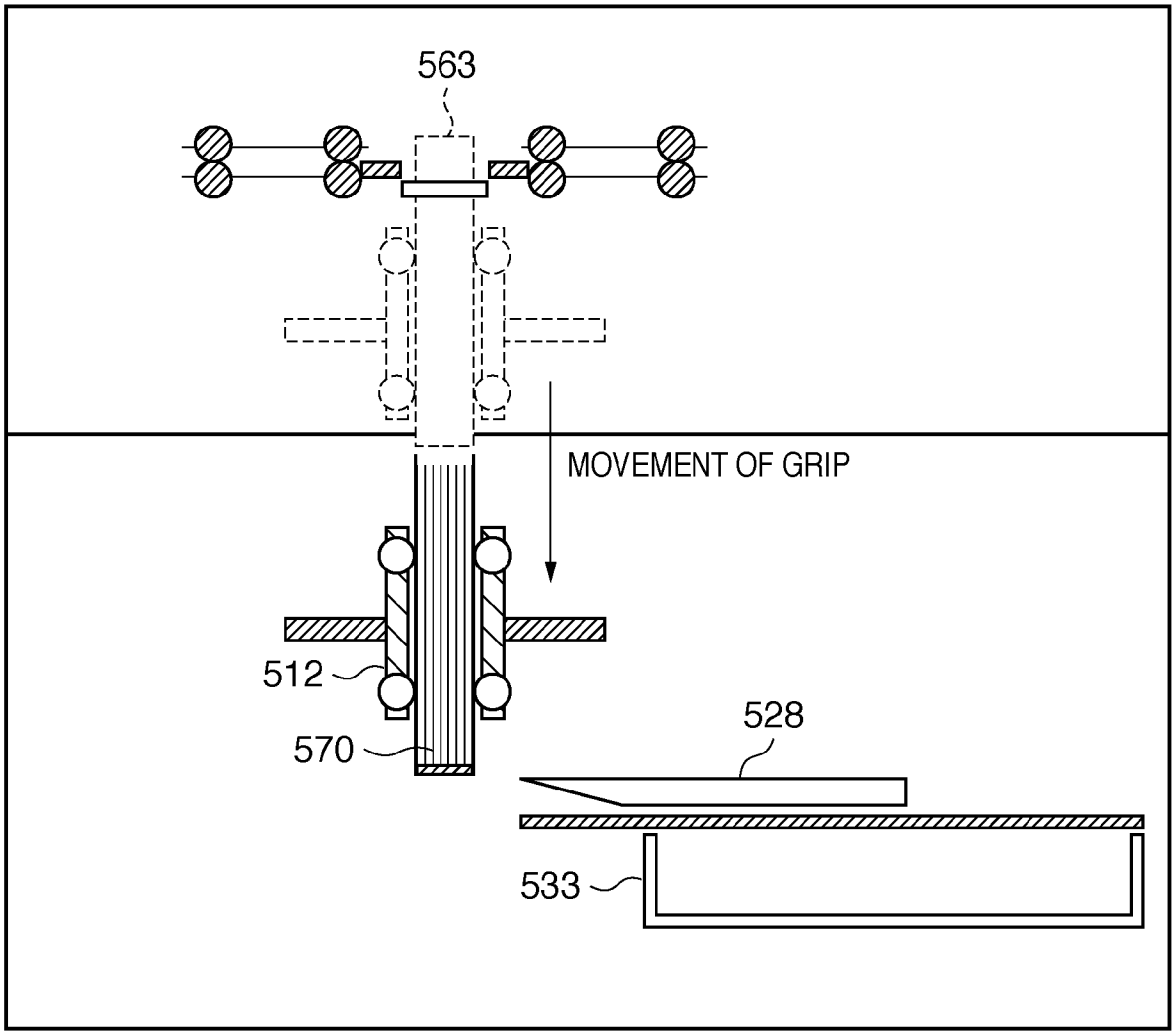
FIG. 12 is a diagram showing a condition in which the trim gripper is descending in the adhesion unit C.

Next, as shown in FIG. 12, the trim gripper 512 descends, thus causing the book 570 to descend downward to a position in the cutting unit D. At this time, the pressing member 563 that had been moved in the horizontal direction is moved to a position that enables it to be pressed against the adhesion portion of a cover sheet. FIG. 12 is a diagram showing a condition in which the trim gripper is descending in the adhesion unit C.

Cutting Unit D Operations

Figure 13:
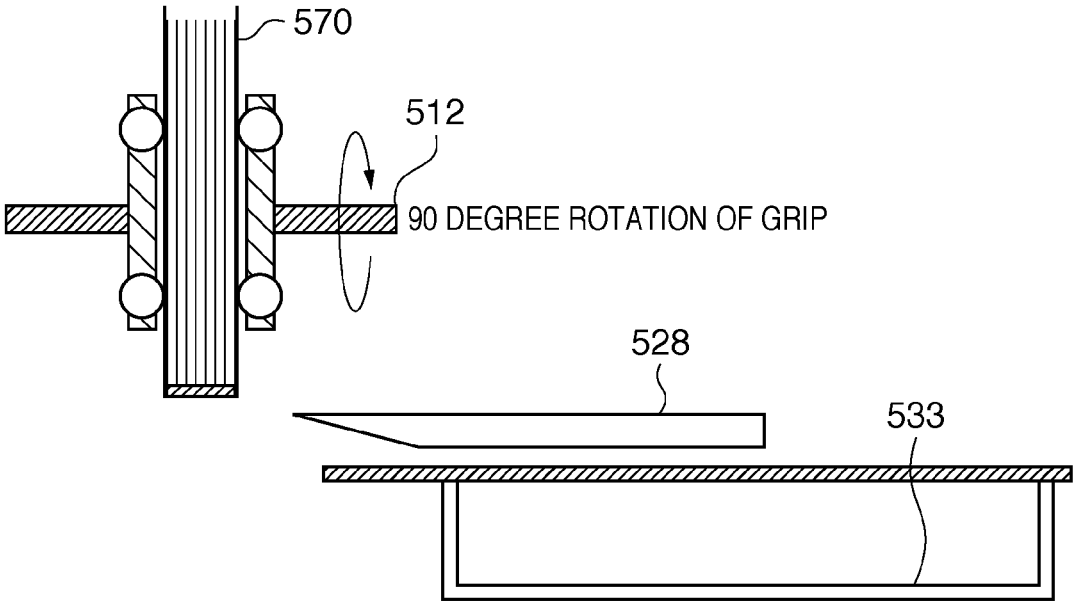
FIG. 13 is a cross-sectional diagram showing a configuration of a cutting unit D.

The following describes operations performed by the cutting unit D with reference to FIGS. 13 to 18. FIG. 13 is a cross-sectional diagram showing a configuration of the cutting unit D.

After the above-described adhesion unit C has formed the book 570 by adhering a cover sheet to a sheet bundle consisting of inner sheets, the book 570 is moved to the cutting unit D by the trim gripper 512, and thereafter, as shown in FIG. 13, the trim gripper 512, the cutter 528, and the cutting scrap receptacle 533 work in cooperation to cut away end portions. Specifically, the trim gripper 512 rotates the book 570 such that different sides of the book are aligned with the cutter 528 to enable those sides (apart from the spine) to be cut.

Figure 14:
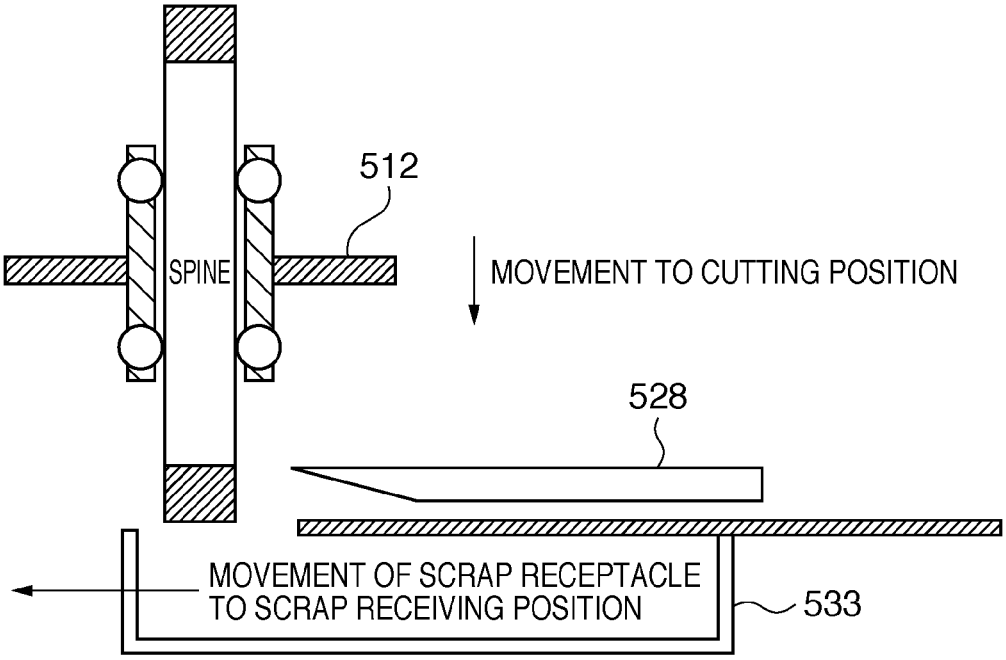
FIG. 14 is a diagram showing a condition in which a cutting scrap receptacle is moving in the cutting unit D.

In the cutting operation, as shown in FIG. 14, first the cutting scrap receptacle 533 moves to a position below the book 570 before the cutter 528 performs cutting. FIG. 14 is a diagram showing a condition in which the cutting scrap receptacle is moving in the cutting unit D.

Figure 15:
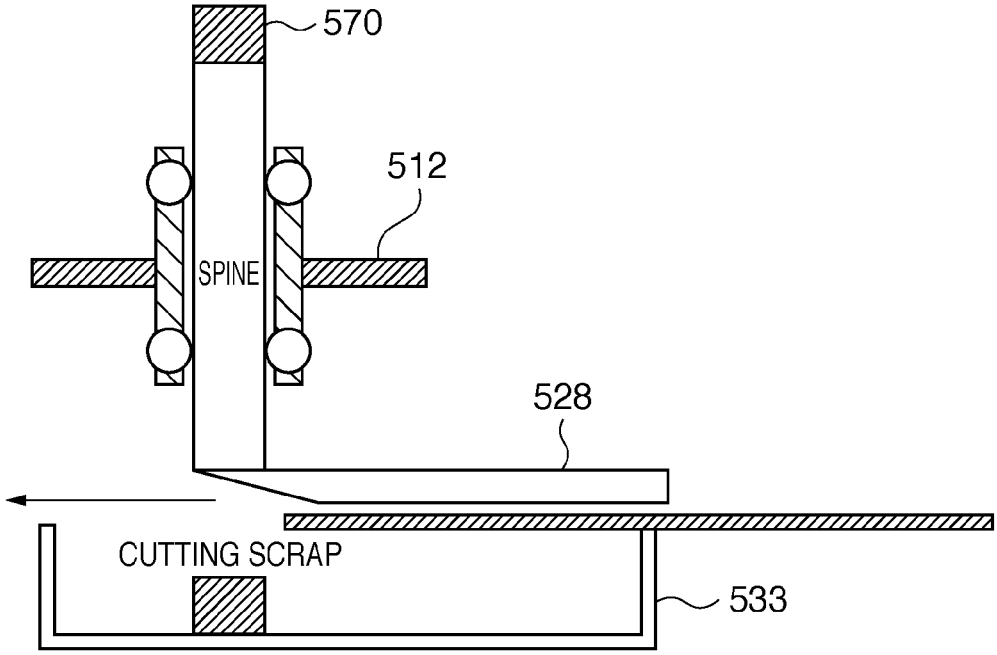
FIG. 15 is a diagram showing the book being cut in the cutting unit D.

Thereafter, the cutter 528 cuts one side of the book 570. At this time, as shown in FIG. 15, cutting scraps are collected in the cutting scrap receptacle 533 that is waiting below the book 570. FIG. 15 is a diagram showing the book being cut in the cutting unit D.

Figure 16:
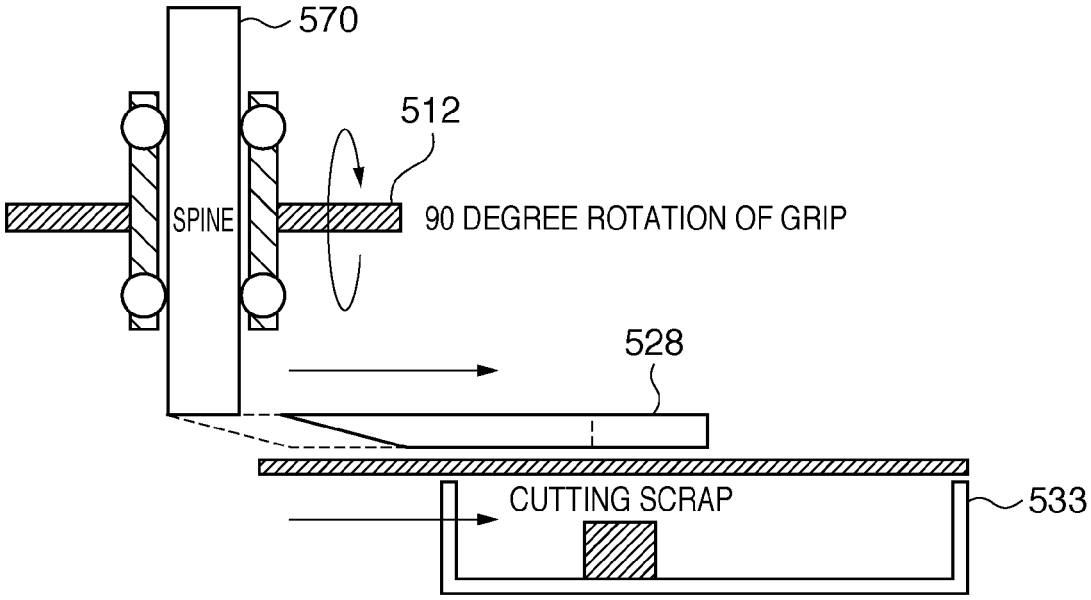
FIG. 16 is a diagram showing a condition in which a cutter and the cutting scrap receptacle are being moved away in the cutting unit D.

Thereafter, as shown in FIG. 16, the cutter 528 is driven in a backward direction, thus being moved to a retracted position, and the cutting scrap receptacle 533 also moves to a retracted position. FIG. 16 is a diagram showing a condition in which the cutter and the cutting scrap receptacle are being moved away in the cutting unit D.

Figure 17:
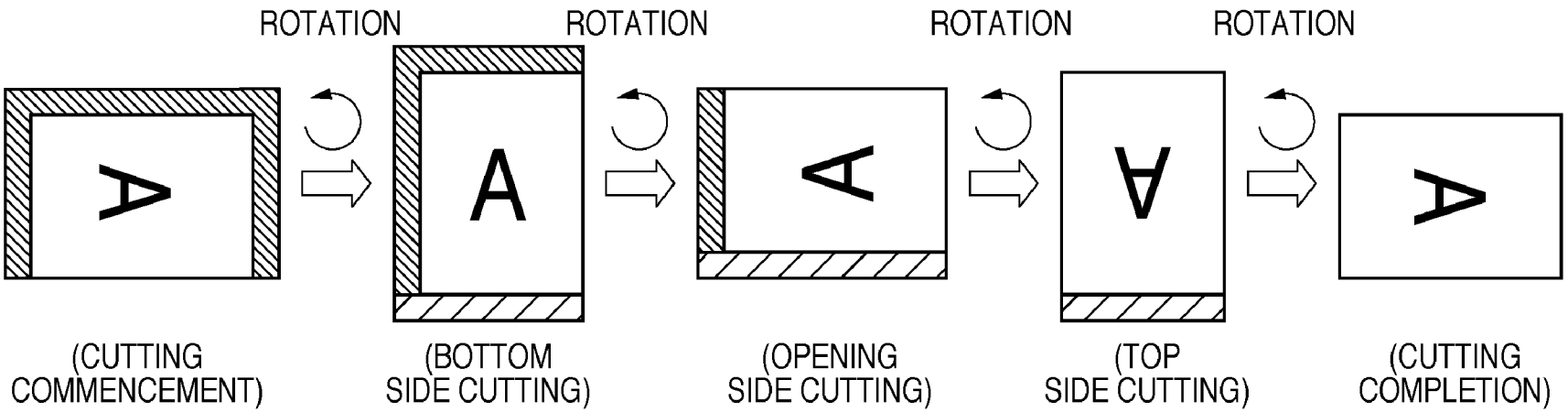
FIG. 17 is a diagram for illustrating a cutting procedure.

FIG. 17 is a diagram for illustrating a cutting procedure. FIG. 17 shows a condition of cutting three sides (i.e., the opening side, the top side, and the bottom side of the book) by the above-described cutting operation performed on the book 570.

Specifically, after the adhesion operation has been performed, the book 570 is moved with the spine end portion facing downward. In order to cut the bottom end of the book, the orientation of the book 570 is rotated by 90 degrees by rotating the rotatable trim gripper 512 by 90 degrees. Next, the opening side is cut by rotating the trim gripper 512 by 90 degrees in the same direction and performing the cutting operation. Finally, the top end is cut by rotating the trim gripper 512 by 90 degrees and performing the cutting operation, thereby ending the cutting of sides other than the spine end portion. It should be noted that after cutting, in order to convey the book 570 to the later-described bookbinding discharge unit with the spine portion facing downward, the trim gripper 512 further rotates the book 570 by 90 degrees without performing the cutting operation.

Figure 18:
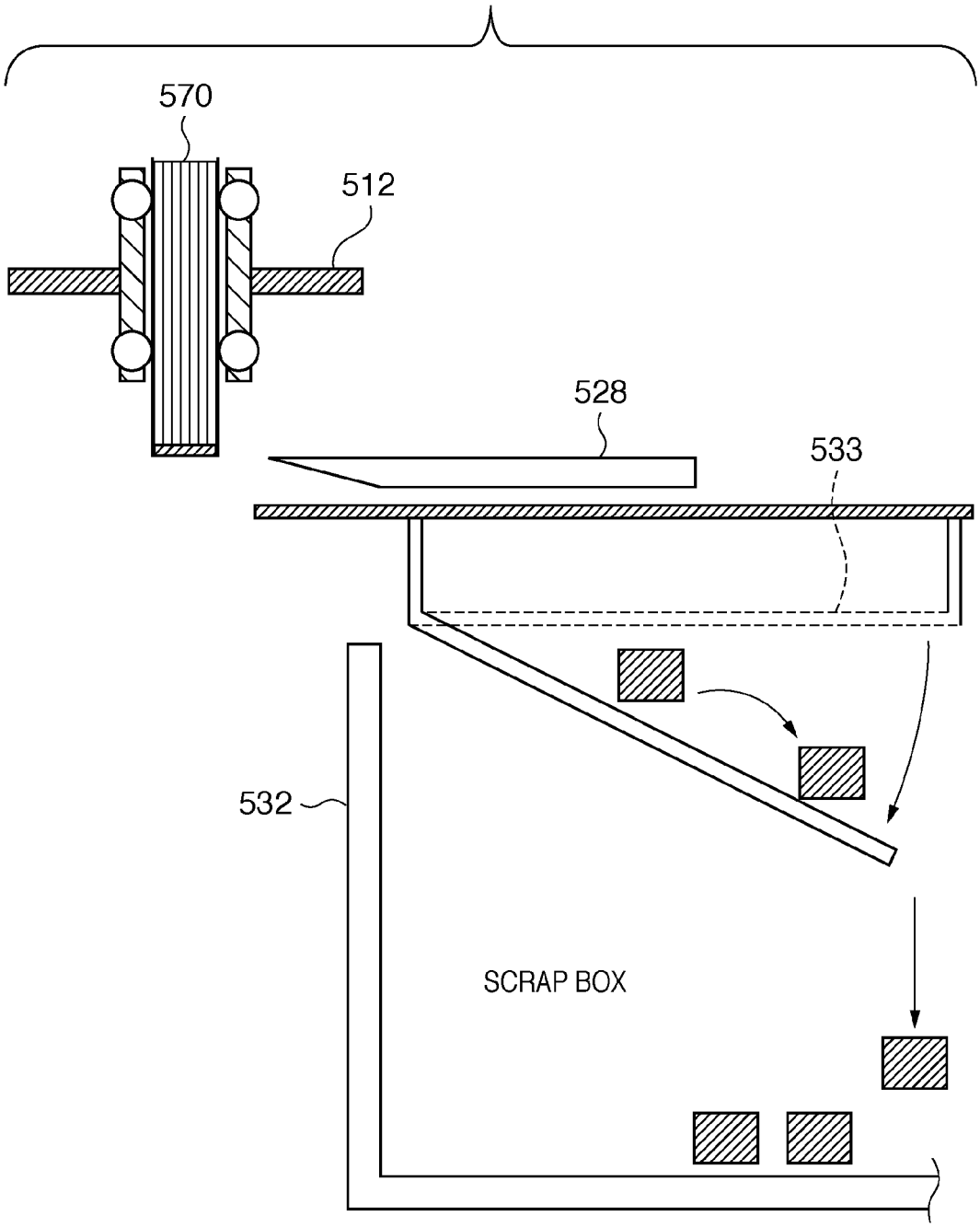
FIG. 18 is a diagram showing a flow of scraps that have been cut away in the cutting unit D.

The cutting scrap receptacle 533 moves between the retracted position for when the cutting operation is not being performed and the scrap receiving position for when the cutting operation is being performed. The retracted position of the cutting scrap receptacle 533 is located above the cutting scrap box 532. Also, as shown in FIG. 18, the cutting scrap receptacle 533 is configured so as to have an openable bottom plate portion, and when the cutting scrap receptacle 533 has moved to the retracted position, the bottom plate portion opens, and cutting scraps in the cutting scrap receptacle 533 are collected in the cutting scrap box 532. FIG. 18 is a diagram showing a flow of scraps that have been cut away in the cutting unit D.

Bookbinding Discharge Unit E Operations

Figure 19:
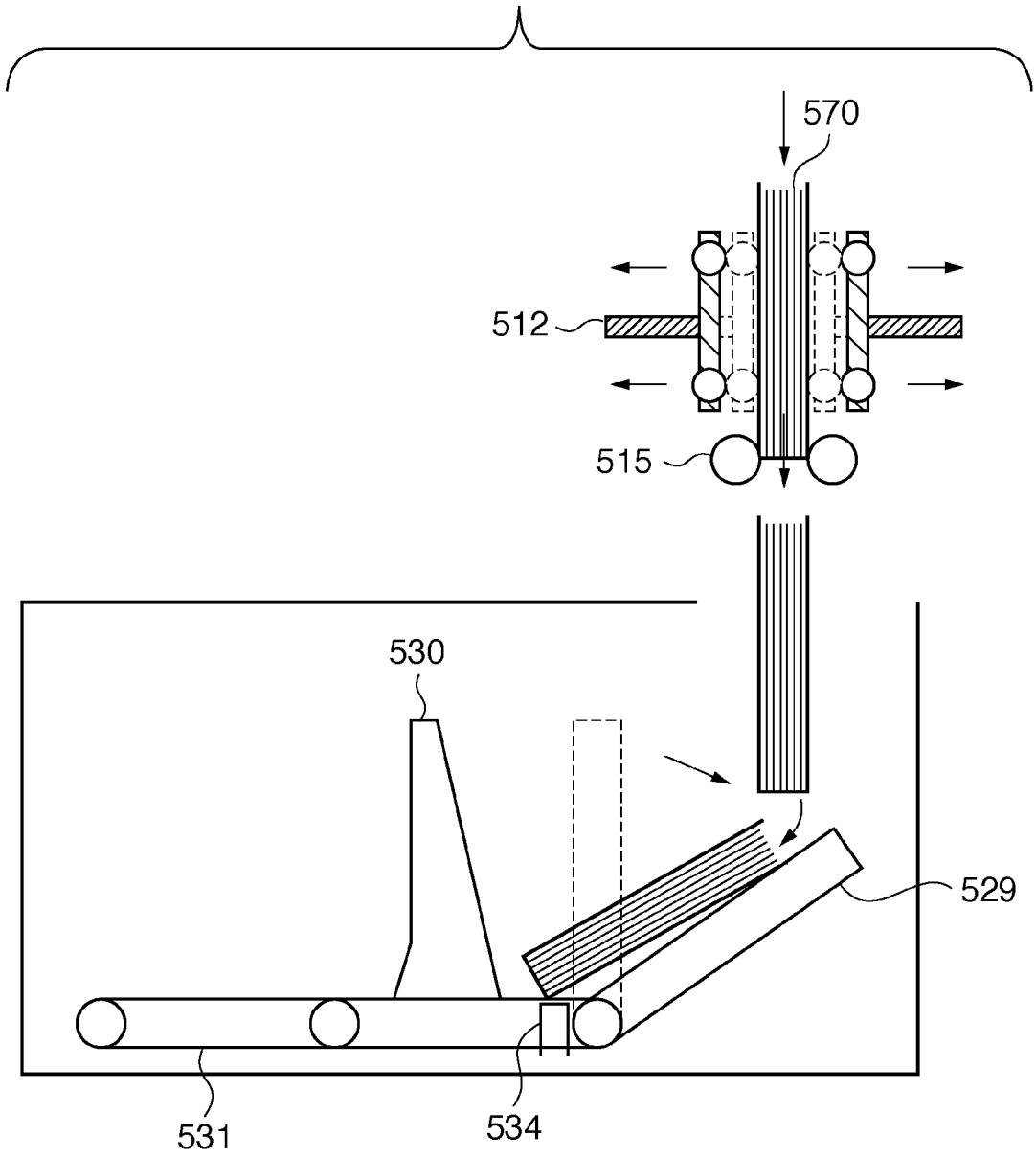
FIG. 19 is a cross-sectional diagram showing an exemplary configuration of a bookbinding discharge unit E.

The following describes operations performed by the bookbinding discharge unit E with reference to FIGS. 19 to 22. FIG. 19 is a cross-sectional diagram showing an exemplary configuration of the bookbinding discharge unit E. The bookbinding discharge unit E includes the trim gripper 512 that conveys a book from the cutting unit D to the bookbinding discharge unit E, the discharge roller 515 that conveys a book to the bookbinding discharge unit E, and a bookbinding stacking plate 529 on which a conveyed book is temporarily stacked. The bookbinding discharge unit E further includes a bookbinding support plate 530 that supports bound books in the vertical direction, a bookbinding discharge stability plate 534, and a discharge conveying belt 531 that moves the bookbinding support plate 530 in the horizontal direction.

After the cutting operation has ended, the trim gripper 512 descends, thus conveying the book 570 to the discharge roller 515 that is directly below the cutting unit D. The discharge roller 515 then conveys the book 570, the trim gripper 512 releases the book 570 from its support, and the book 570 moves to a predetermined position in the adhesion unit C. At this time, as shown in FIG. 19, the bookbinding stacking plate 529 is leaning in the right direction in the bookbinding discharge unit E, and the book 570 is stacked onto the bookbinding stacking plate 529 by the discharge roller 515.

Figure 20:
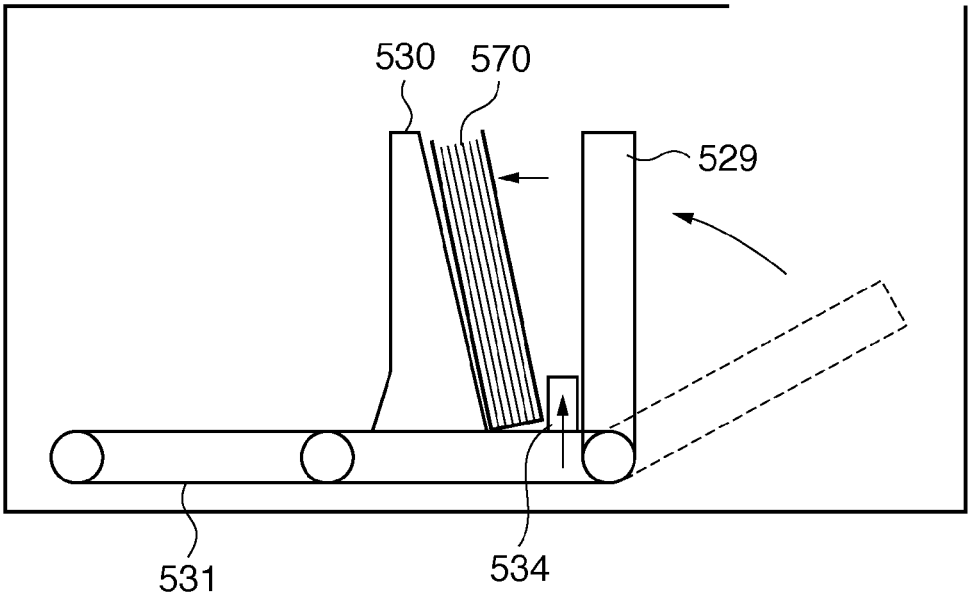
FIG. 20 is a diagram showing a condition in which the book is being supported in the bookbinding discharge unit E.

Thereafter, the bookbinding stacking plate 529 that was leaning is made to stand upright in the vertical direction, and the book 570 is supported in an upright condition by the bookbinding support plate 530. Here, as shown in FIG. 20, the bookbinding discharge stability plate 534 that is below the discharge conveying belt 531 rises, and therefore the book 570 is supported between the bookbinding support plate 530 and the bookbinding discharge stability plate 534. FIG. 20 is a diagram showing a condition in which the book is being supported in the bookbinding discharge unit E.

Figure 21:
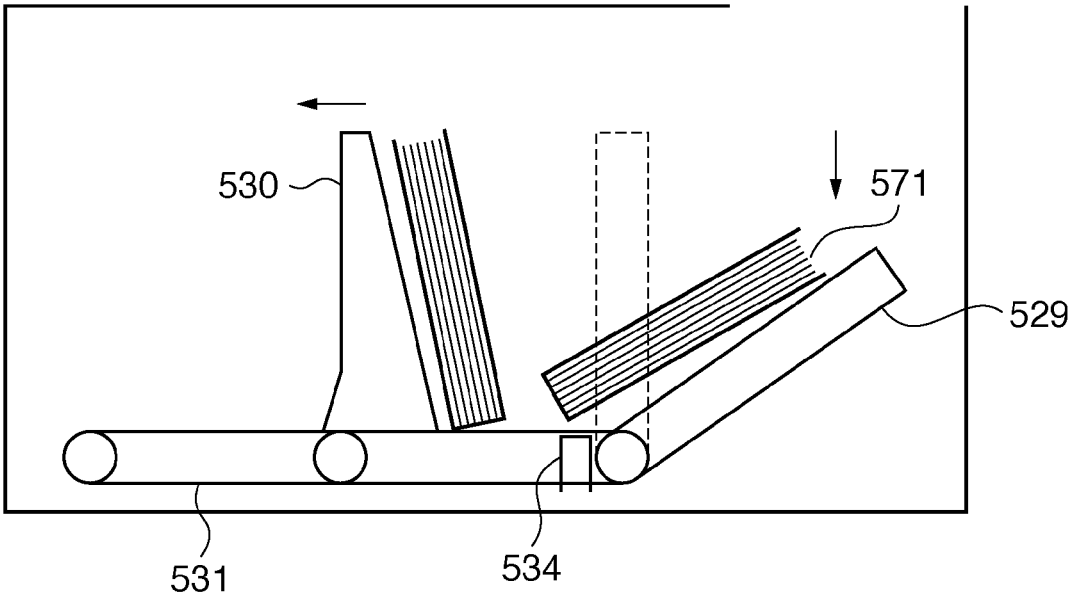
FIG. 21 is a diagram showing a condition in which a discharge space is retained in the bookbinding discharge unit E.
Figure 22:
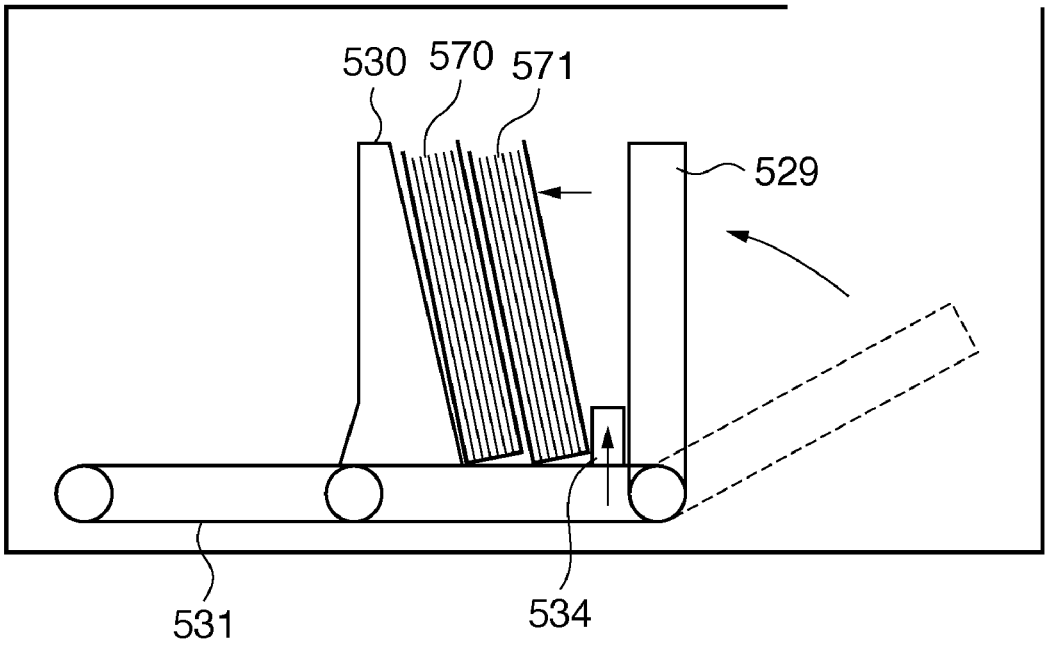
FIG. 22 is a diagram showing a condition in which books are being stored upright in the bookbinding discharge unit E.

Thereafter, as shown in FIG. 21, the discharge conveying belt 531 moves the bookbinding support plate 530 to the left in order to retain a discharge space for when a next book 571 is conveyed. FIG. 21 is a diagram showing a condition in which a discharge space is retained in the bookbinding discharge unit E. When the discharge space for the book 571 has been retained, as shown in FIG. 22, the book 571 can be stored upright next to the book 570 by again performing the discharge operation described above. FIG. 22 is a diagram showing a condition in which books are being stored upright in the bookbinding discharge unit E.

Operation Display Unit Configuration

Figure 29:
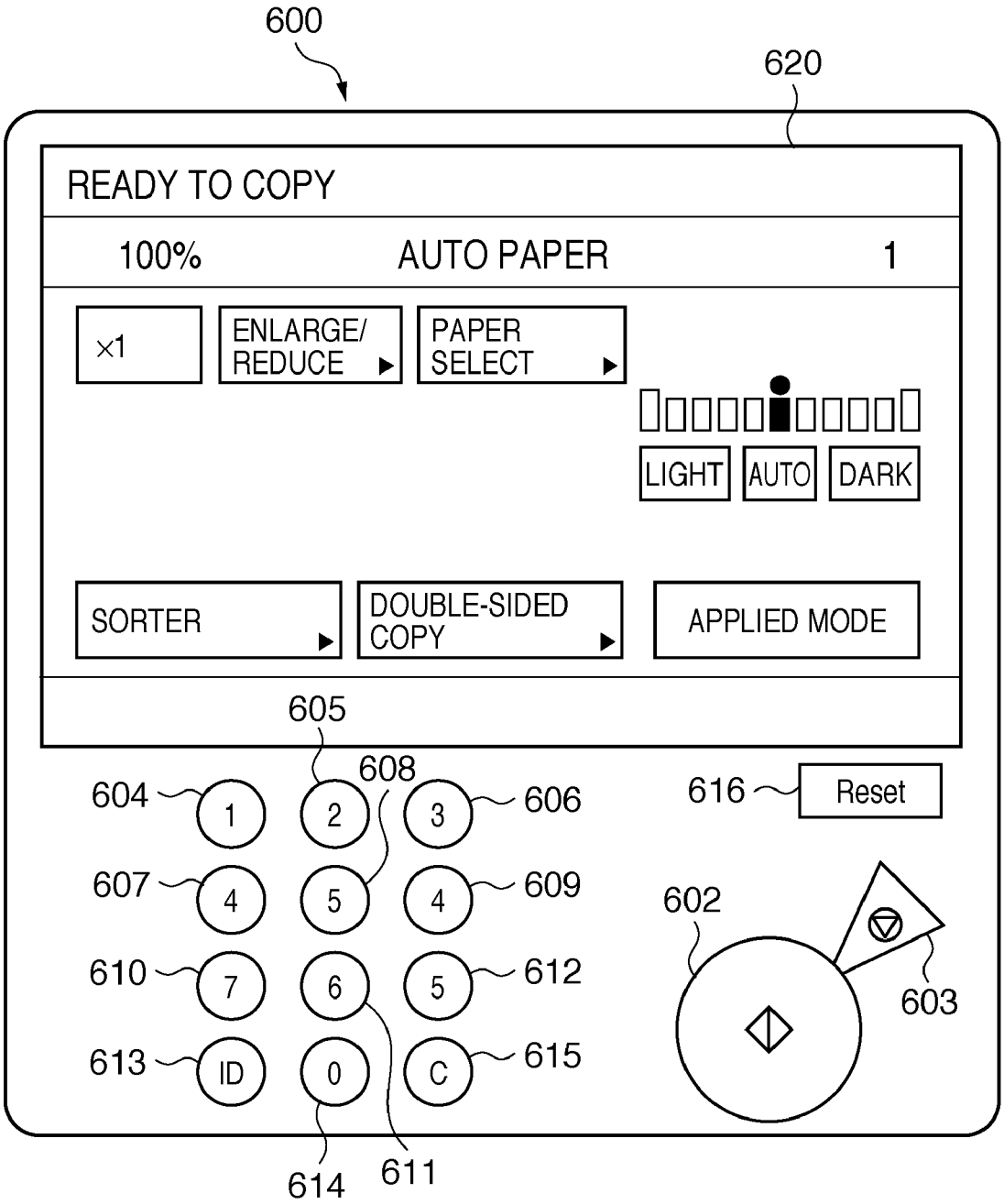
FIG. 29 is a diagram showing an exemplary configuration of an operation display unit included in the image forming apparatus.

The following describes an operation display unit 600 (shown in FIG. 1) in the image forming apparatus 10 with reference to FIG. 29. FIG. 29 is a diagram showing an exemplary configuration of the operation display unit included in the image forming apparatus.

Arranged on the operation display unit 600 are a start key 602 for starting the image forming operation, a stop key 603 for stopping the image forming operation, and ten keys 604 to 612 and 614 for performing number settings and the like. Furthermore, an ID key 613, a clear key 615, a reset key 616 and the like are arranged on the operation display unit 600. Also, a liquid crystal display unit 620 over which a touch panel has been formed is disposed over the operation display unit 600, and soft keys can be created on the screen.

For example, in the image forming apparatus 10 according to the present embodiment, the post processing apparatus 400 and case binding apparatus 500 have various post-processing modes such as non-sorting and sorting, and processing modes such as bookbinding mode. Setting such processing modes is performed by an input operation from the operation display unit 600.

Overall System Block Diagram

Figure 47:
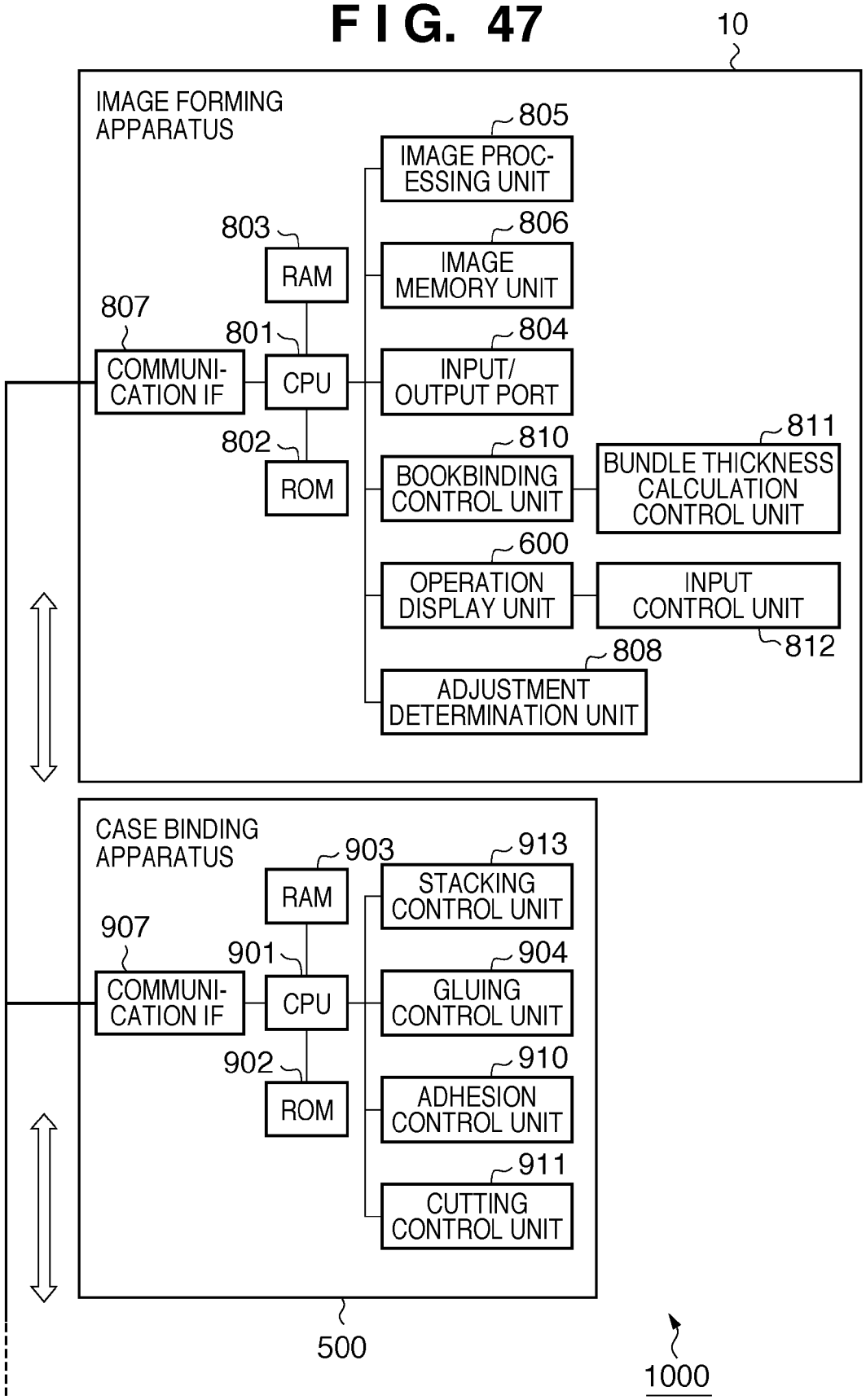
FIG. 47 is a diagram showing a configuration of control in an image forming system according to the first embodiment.

The following describes the configuration of various control units in the image forming system 1000 that is constituted from the image forming apparatus 10 and the case binding apparatus 500 with reference to FIG. 47. FIG. 47 is a diagram showing a configuration of control in the image forming system according to the first embodiment.

A CPU 801 performs basic control of the image forming apparatus 10, and is connected to a ROM 802 storing a control program, a RAM 803 for performing processing, and an input/output port 804, via an address bus and a data bus. An area of the RAM 803 is used as backup RAM in which data is not erased even if the power supply is turned off.

Connected to the input/output port 804 are a motor controlled by the image forming apparatus 10, various types of stack apparatuses such as a clutch, and an input apparatus that sends input to the image forming apparatus 10, such as a sensor that detects the position of a sheet. In accordance with the content of the control program in the ROM 802, the CPU 801 controls sequential input and output via the input/output port 804 and executes image forming processing.

The CPU 801 is also connected to the operation display unit 600 shown in FIGS. 1 and 29, and the CPU 801 controls displays shown by the operation display unit 600 and key input. The operation display unit 600 further includes an input control unit 812. Details of this unit are described later. The CPU 801 is furthermore connected to an image processing unit 805 that processes a signal that has been converted to an electrical signal by the image sensor 109, and an image memory unit 806 that stores processed images.

A communication IF 807 is a communication IF for performing communication between the CPU 801 and the case binding apparatus 500, and the communication IF 807 communicates with a CPU 901 in the case binding apparatus 500 via a communication IF 907 in the case binding apparatus 500.

An adjustment determination unit 808 determines whether adjustment processing is to be performed at a time of starting image forming or during image forming. Here, adjustment processing refers to, for example, adjustment processing in the fixing unit 117, and is processing that is performed in the case of successively forming images on sheets having different sizes. A case binding control unit 810 includes a bundle thickness calculation control unit 811 that is described later, and performs overall control of the case binding apparatus 500.

The CPU 901 performs basic control of the case binding apparatus 500, and is connected to a ROM 902 storing a control program and a RAM 903 for performing processing via an address bus and a data bus. An area of the RAM 903 is used as backup RAM in which data is not erased even if the power supply is turned off. The case binding apparatus 500 executes bookbinding processing by, based on a signal from the CPU 901, performing overall control of a stacking control unit 913, a gluing control unit 904, an adhesion control unit 910, and a cutting control unit 911 that are described later. The following describes the various control units in detail.

Input Control Unit

Figure 34:
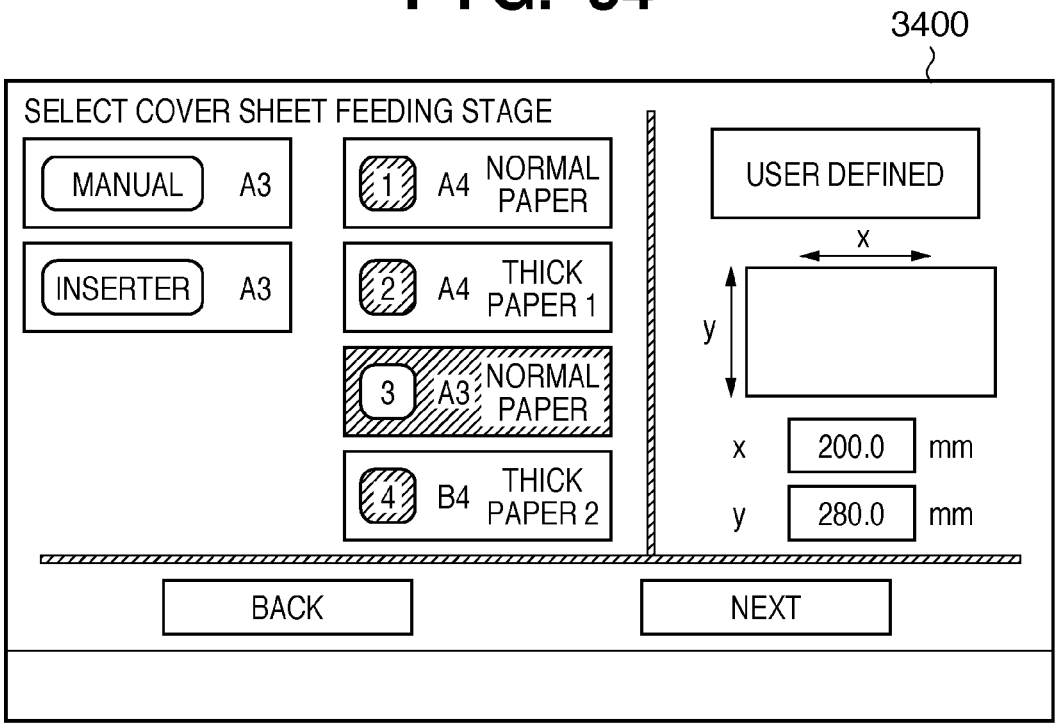
FIG. 34 shows an exemplary display screen displayed on the operation display unit.
Figure 35:
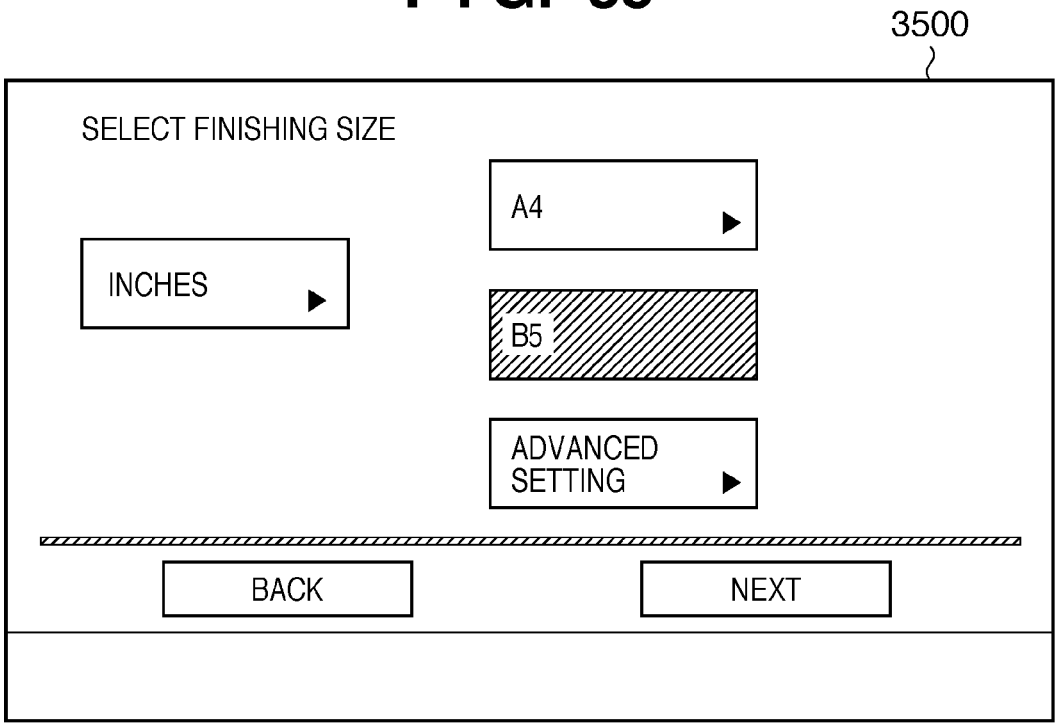
FIG. 35 shows an exemplary display screen displayed on the operation display unit.
Figure 36:
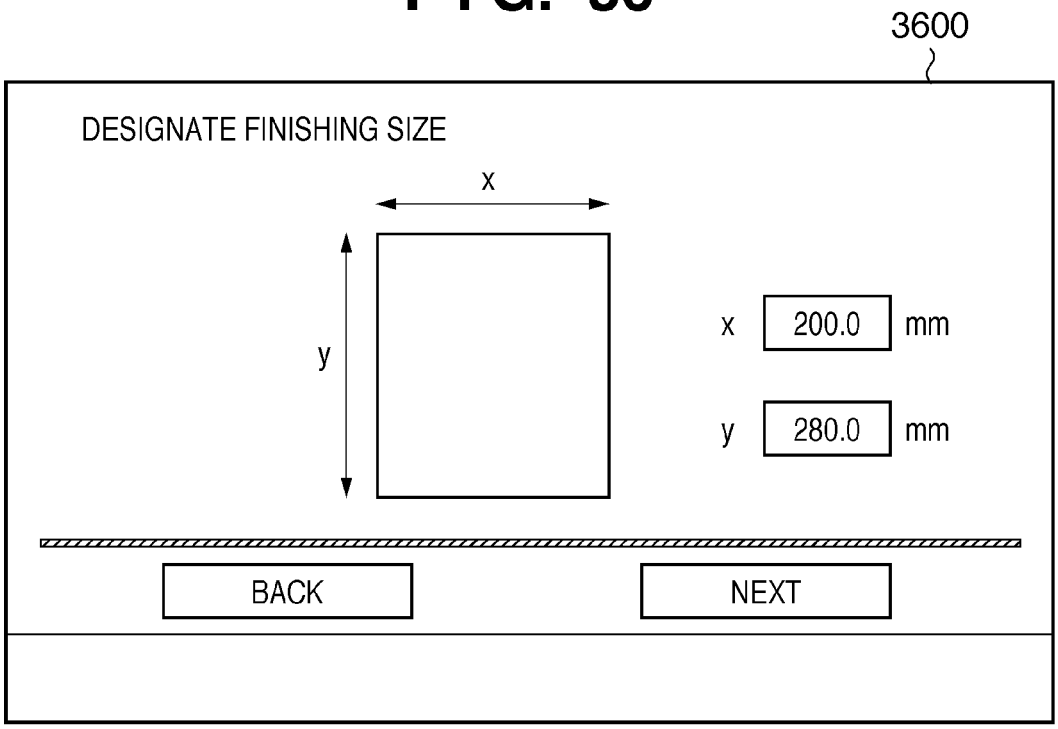
FIG. 36 shows an exemplary display screen displayed on the operation display unit.
Figure 37:
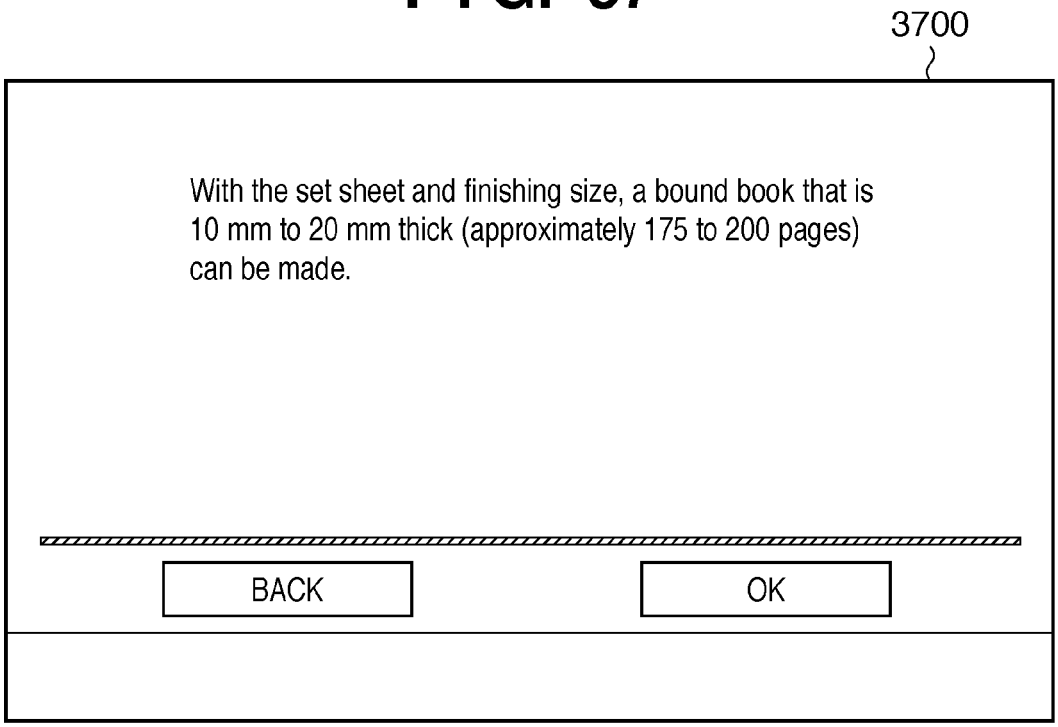
FIG. 37 shows an exemplary display screen displayed on the operation display unit.

First is a detailed description of the input control unit 812. The bookbinding control unit 810 acquires, as necessary information, inner sheet size information regarding the size of sheets stored in a sheet feeding stage that has been set via an inner sheet feeding stage selection screen (FIG. 33) displayed on the operation display unit 600 as the input control unit 812 included therein. Also, the bookbinding control unit 810 acquires cutting amount information with respect to the inner sheets from a difference between the inner sheet size information and finishing size information that has been set via a finishing size designation screen (FIGS. 35 and 36). Furthermore, the bookbinding control unit 810 acquires cover sheet size information regarding the size of sheets stored in a sheet feeding stage that has been set via a cover sheet feeding selection screen (FIG. 34). The input control unit 812 displays these display screens on the operation display unit 600 and transmits information input via these display screens to the various control units.

Bundle thickness calculation control unit

Next is a detailed description of the bundle thickness calculation control unit 811. Based on the following parameters, the bundle thickness calculation control unit 811 calculates a range for a bundle thickness Z according to which bookbinding is possible, with use of the inner sheet size information, finishing size information, and cover sheet size information that have been set via the input control unit 812, as well as a maximum cutting amount that has been set in advance as an apparatus function.

Cover sheet threshold length: $X1=(A-B)\times2+C$

Cover sheet reference length for excessive cutting amount: $X2=(A-B+Dmax)\times2$ Reference length for insufficient cover sheet length: $X3=(A-B)\times2$ where A: opening side direction length of inner sheet size;

B: cutting amount in opening side direction;

C: maximum inner sheet bundle thickness; and

Dmax: maximum cutting amount.

Here, according to the relationship between the cover sheet length and the values calculated as X1, X2, and X3, it is possible for the cover sheet cutting amount to be excessive, or for the length of the cover sheet to be insufficient.

Case of an excessive cover sheet cutting amount

If the cover sheet length Y exceeds the cover sheet reference length for excessive cutting amount X2 ($Y>X2$), it is determined that it is possible that the cover sheet cutting amount will exceed the maximum cutting amount Dmax. In this case, if the range for the bundle thickness Z is $(Y-X2)\leqq Z\leqq C$, the maximum cutting amount Dmax is not exceeded.

Specific Example

The following shows an example of control performed by the bundle thickness calculation control unit 811 in the case of the following parameters.

Cover sheet size: user defined size (297×450 mm)

Inner sheet size: A4 (210×279 mm)

Finishing size: B5 (182×257 mm)

Here, the following values are obtained according to the set values for the cover sheet size/inner sheet size/finishing size:

A: opening side direction length of inner sheet size=210 mm

B: opening side direction cutting amount=inner sheet size−finishing size=210-182=28 mm C: maximum inner sheet bundle thickness=20 mm Dmax: maximum cutting amount=39 mm The maximum inner sheet bundle thickness/maximum cutting amount are values determined according to the performance and configuration of the apparatus, and are the same values regardless of the set values. Accordingly, the following values are obtained for X1, X2, and X3.

Cover sheet threshold length: $X1=(A-B)\times2+C=(210-28)\times2+20=384$ mm

Cover sheet reference length for excessive cutting amount: $X2=(A-B+Dmax)\times2=(210-28+39)\times2=442$ mm Reference length for insufficient cover sheet length: $X3=(A-B)\times2=(210-28)\times2=364$ mm At this time, since the relationship (cover sheet length Y=450 mm)>(cover sheet reference length for excessive cutting amount X2=442 mm) exists, it is determined that it is possible that the cover sheet cutting amount will exceed the maximum cutting amount Dmax.

Here, the maximum cutting amount Dmax=39 mm is not exceeded if the range for the bundle thickness Z is within the range:

$$8\text{ mm (i.e. 450 mm}-442\text{ mm)}\leqq Z\leqq 20\text{ mm.}$$

Case of an insufficient cover sheet length If the cover sheet length Y is less than the cover sheet threshold length X1 (i.e. $Y<X1$), it is determined that it is possible that the length of the cover sheet is such that after cutting, the end of the cover sheet will be inward (i.e. short) of the opening side end face. Here, the end face of the cover sheet will not be inward of the opening side end face if the range for the bundle thickness Z satisfies $Z\leqq Y-X3$.

Specific Example

The following shows an example of control performed by the bundle thickness calculation control unit 811 in the case of the following parameters.

Cover sheet size: user defined size 270×370 mm)

Inner sheet size: A4 (210×279 mm)

Finishing size: B5 (182×257 mm) An example of the bundle thickness calculation unit in the case of the above parameters will be described below. Here, the following values are obtained according to the set values for the cover sheet size/inner sheet size/finishing size.

A: opening side direction length of inner sheet size=210 mm

B: opening side direction cutting amount=inner sheet size−finishing size=210−182=28 mm C: maximum inner sheet bundle thickness=20 mm Dmax: maximum cutting amount=39 mm The maximum inner sheet bundle thickness/maximum cutting amount are values determined according to the performance and configuration of the apparatus, and are the same values regardless of the set values. The following values are obtained for X1, X2, and X3.

Cover sheet threshold length: X1=(A−B)×2+C=(210−28)×2+20=384 mm

Cover sheet reference length for excessive cutting amount: X2=(A−B+Dmax)×2=(210−28+39)×2=442 mm Reference length for insufficient cover sheet length: X3=(A−B)×2=(210−28)×2=364 mm At this time, since the relationship (cover sheet length Y=370 mm)<(cover sheet threshold length X1=384 mm) exists, it is determined that it is possible that the cover sheet length is such that after cutting, the end face of the cover sheet will be short of the opening side end face. Here, the end face of the cover sheet will not be inward of the opening side end face if the range for the bundle thickness Z is Z≦6 mm (370 mm−364 mm).

Adjustment Determination Unit

Next is a detailed description of the adjustment determination unit 808. The adjustment determination unit 808 compares the size of the sheet that is to pass through the fixing unit 117 and the size of sheets that have previously passed through, and determines whether adjustment processing is necessary. If cutting processing is set in the post-processing step, the determination regarding the necessity of adjustment processing is made in consideration of the finishing size after cutting.

Adjustment processing includes processing such as the following. For example, there is processing for preventing differences in image density and a fixing offset that occur when the temperature becomes uneven at the center and ends of the fixing roller due to a large sheet being fed after small recording sheets have been fed in succession. In this case, fixing adjustment is performed until the temperature of the fixing roller has been stabilized. Also, when recording sheets having a thick sheet thickness are fed in succession, there are cases in which the end portions of the recording sheets leave small marks or dents on the surface of the fixing roller, and there is processing for preventing the phenomenon in which small flaws appear in an image when a toner image is fixed onto a sheet by such a flawed portion. In this case, flaws on the surface of the fixing roller are removed by, for example, bringing another roller or blade into contact with the surface of the fixing roller.

Bookbinding Mode Setting Flow

Figure 48:
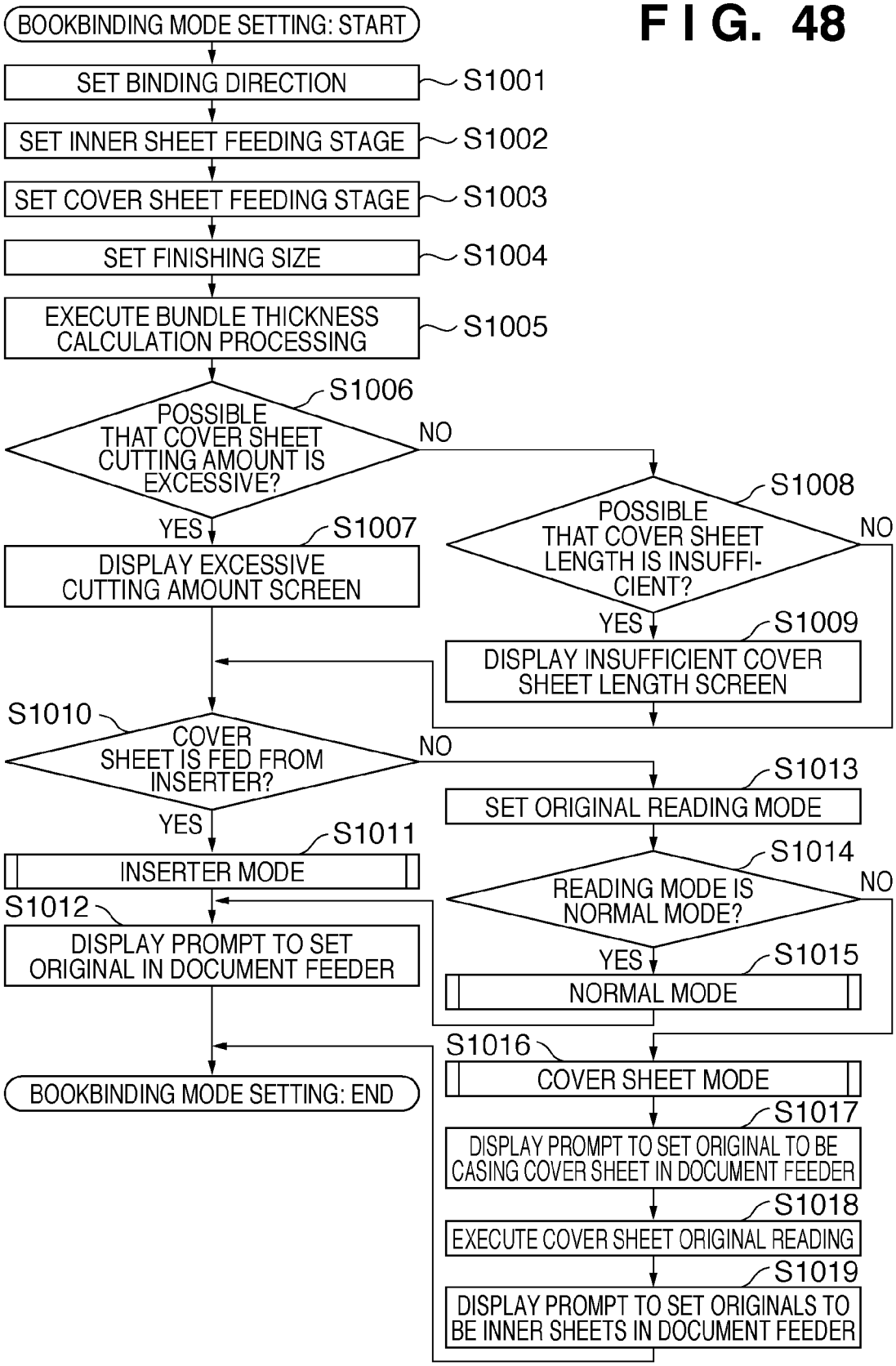
FIG. 48 is a flowchart showing a bookbinding mode setting procedure according to the first embodiment.

The following describes a flow of bookbinding mode setting with reference to FIGS. 30 to 42 and the flowchart of FIG. 48. FIG. 48 is a flowchart showing a bookbinding mode setting procedure according to the first embodiment. Overall control of the processing described below is performed by the CPU 801. FIGS. 30 to 42 show exemplary display screens displayed on the operation display unit. It should be noted that in the processing described below, user input via display screens 3000 to 4200 is acquired by the input control unit 812.

Figure 30:
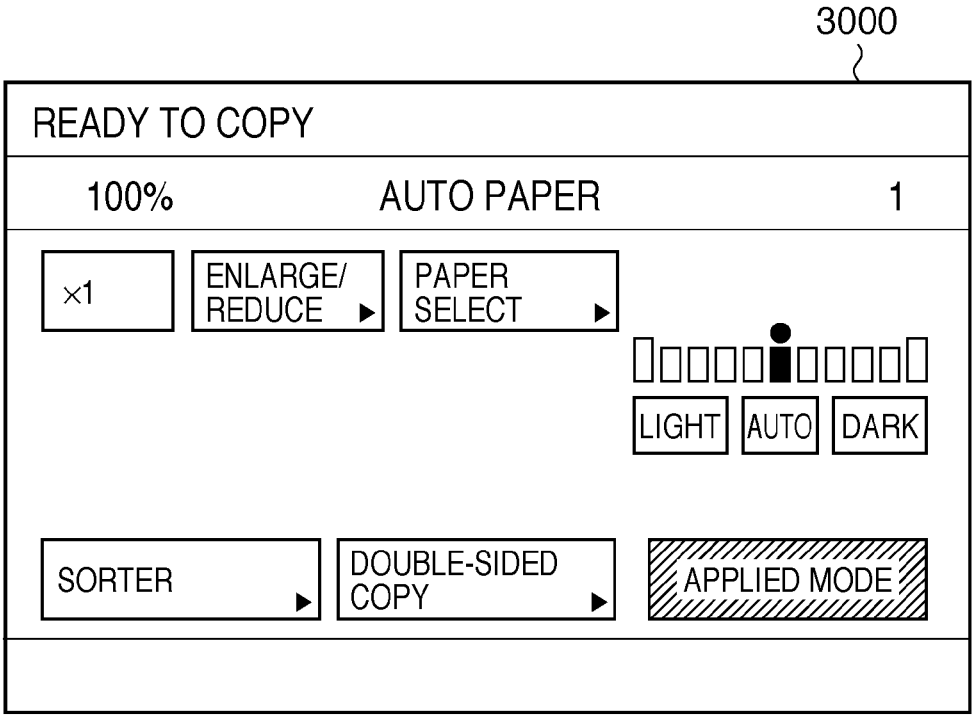
FIG. 30 shows an exemplary display screen displayed on the operation display unit.
Figure 31:
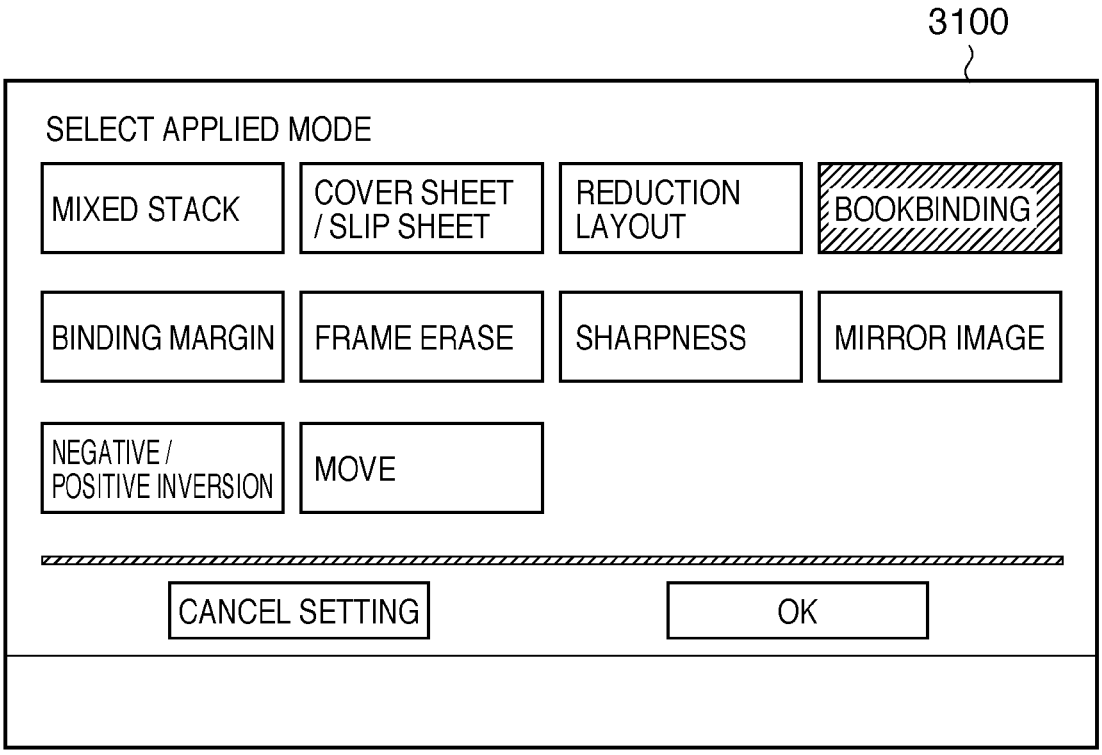
FIG. 31 shows an exemplary display screen displayed on the operation display unit.

The setting of the bookbinding mode starts from a display screen 3000 shown in FIG. 30 that is displayed on the liquid crystal display unit 620 of the operation display unit 600. The display screen 3000 is the initial screen, and when an "Applied Mode" key, which is a soft key, is selected, the display transitions to a display screen 3100 shown in FIG. 31. The display screen 3100 is a screen for selecting the applied mode. When a "Bookbinding" soft key is selected from among the applied mode menu, the setting of the bookbinding mode is started.

Figure 32:
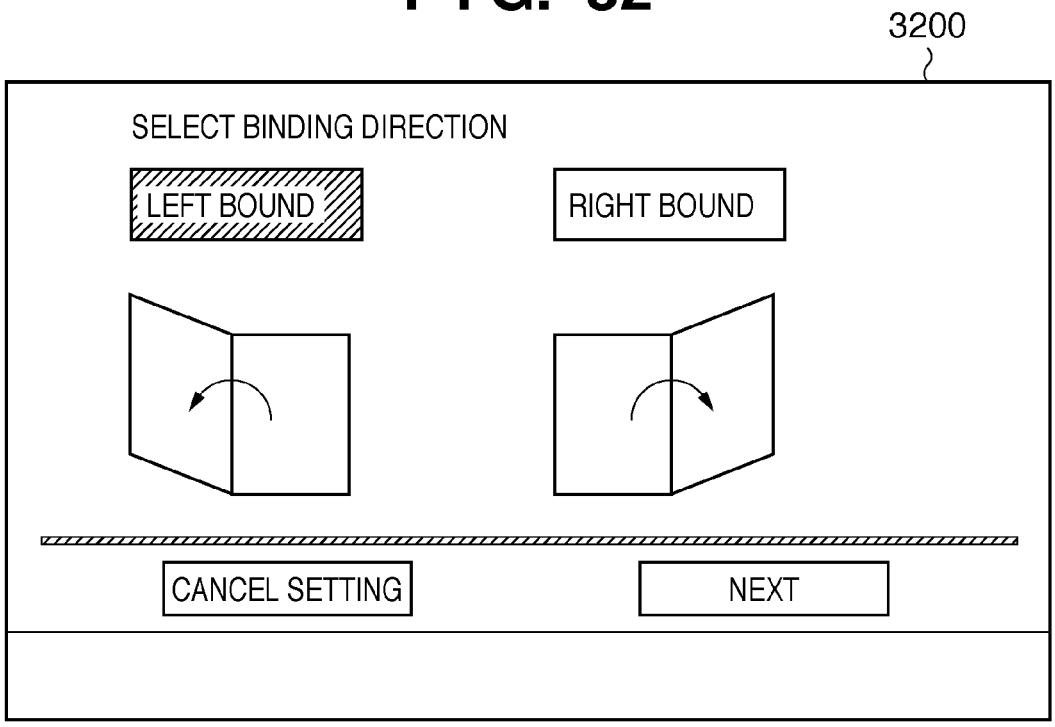
FIG. 32 shows an exemplary display screen displayed on the operation display unit.

When the setting of the bookbinding mode has started, in step S1001 the CPU 801 causes a display screen 3200 shown in FIG. 32 to be displayed, and allows either "Right Bound" or "Left Bound" to be selected as the binding direction of the product. Here, "Right Bound" indicates a binding method in which when the book is opened, the page numbers increase from the right-side page to the left-side page. On the other hand, "Left Bound" indicates a binding method in which the page numbers increase from the left-side page to the right-side page.

Figure 33:
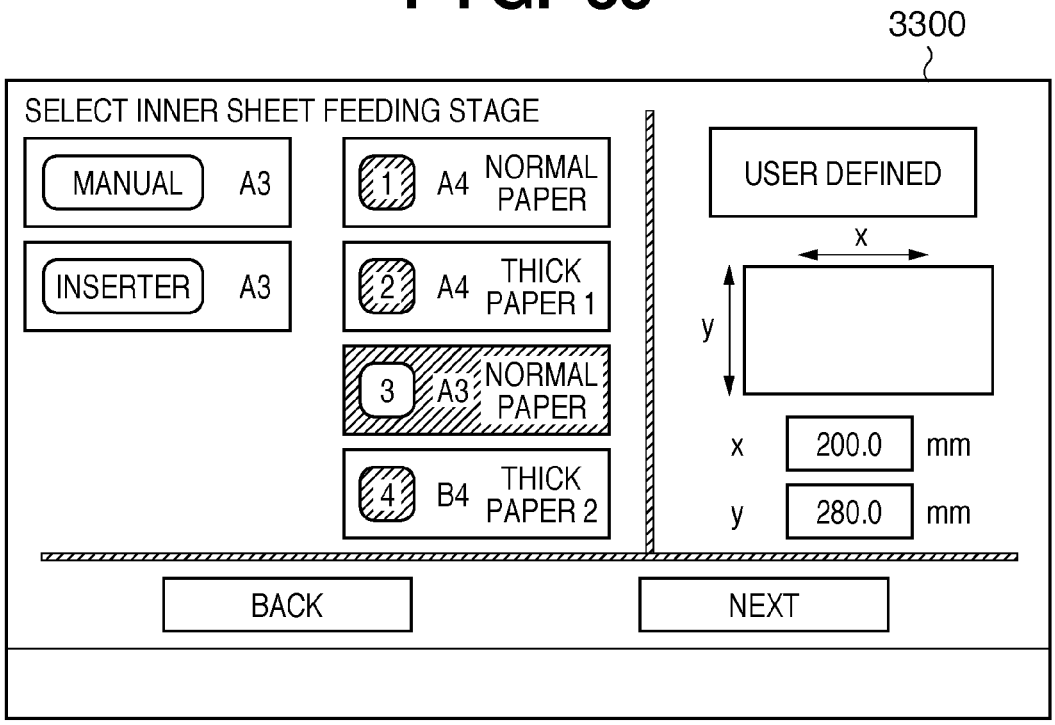
FIG. 33 shows an exemplary display screen displayed on the operation display unit.

When the binding direction is selected and a "Next" soft key is pressed, in step S1002 the CPU 801 causes the operation display unit 600 to display a display screen 3300 shown in FIG. 33 that is for performing inner sheet feeding stage setting. In the display screen 3300, a sheet feeding stage for feeding a sheet bundle to be encased in a casing cover sheet is selected. It is also possible to designate an arbitrary size as a user definition.

When the sheet bundle feeding stage is selected and the "Next" soft key is pressed, in step S1003 the CPU 801 causes a display screen 3400 shown in FIG. 34 to be displayed, and allows a sheet feeding stage for feeding the casing cover sheet to be selected. In the display screen 3400, either a sheet feeding cassette or an inserter is selected as the casing cover sheet feeding source. It is also possible to designate any size according to user definition.

Next, in step S1004 the CPU 801 causes display screens 3500 and 3600 that are shown in FIGS. 35 and 36 respectively to be displayed, and allows finishing size setting to be performed. In the display screen 3500, the size after cutting is selected from among prescribed sizes, or if an "Advanced Setting" soft key is pressed, the display then transitions to the display screen 3600 and specific size is designated.

When the finishing size is set and a "Set" soft key is pressed, in step S1005 the CPU 801 causes the bundle thickness calculation control unit 811 to perform the calculation processing described above. Then, in step S1006 the CPU 801 determines whether it is possible for the largest cutting amount of the cover sheet to be greater than the maximum cutting amount, which is the maximum amount that can be cut. In the case of determining affirmatively, processing proceeds to step S1007 in which the CPU 801 causes a display screen 3700 shown in FIG. 37 to be displayed, which shows the user information regarding possible bundle thicknesses for bookbinding. On the other hand, in the case of determining negatively, processing proceeds to step S1008 in which the CPU 801 determines whether it is possible for the cover sheet end face in the opening side direction to be inward of the opening side end face at the finished bookbinding size.

Figure 38:
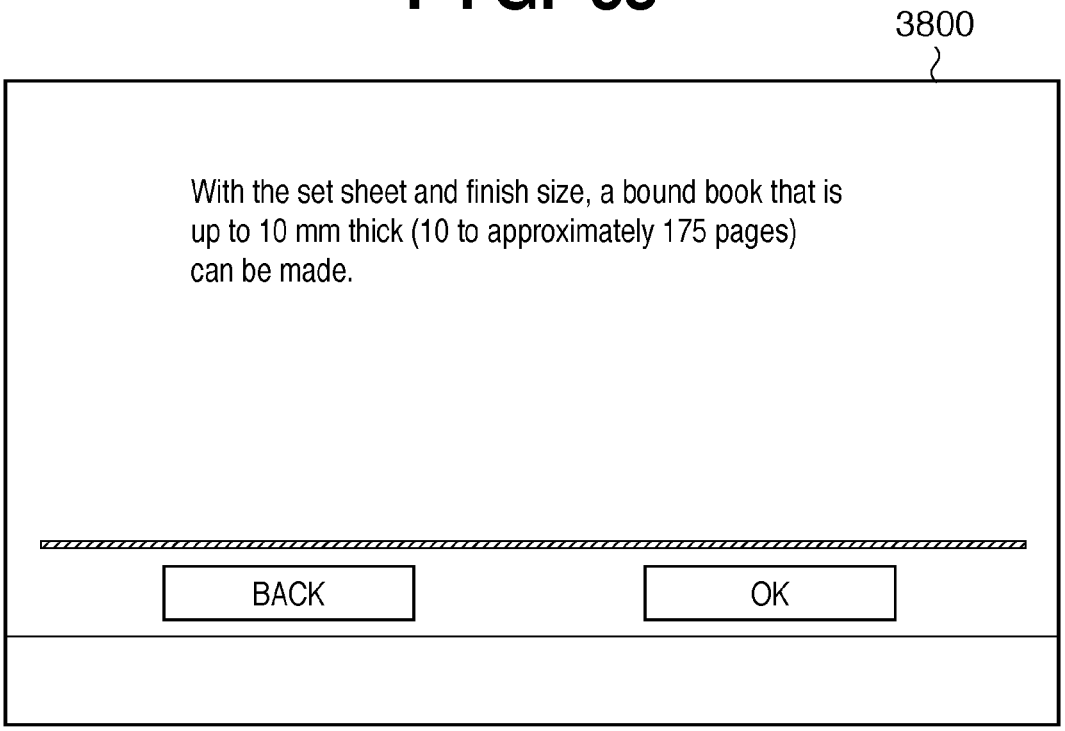
FIG. 38 shows an exemplary display screen displayed on the operation display unit.
Figure 39:
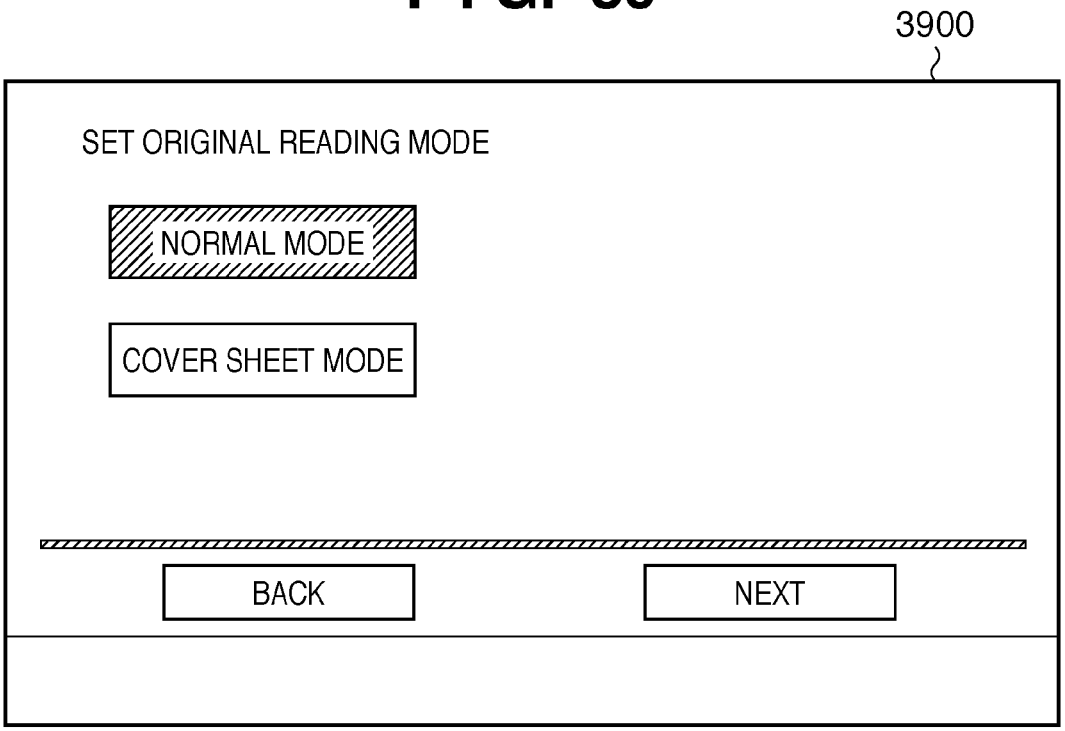
FIG. 39 shows an exemplary display screen displayed on the operation display unit.
Figure 40:
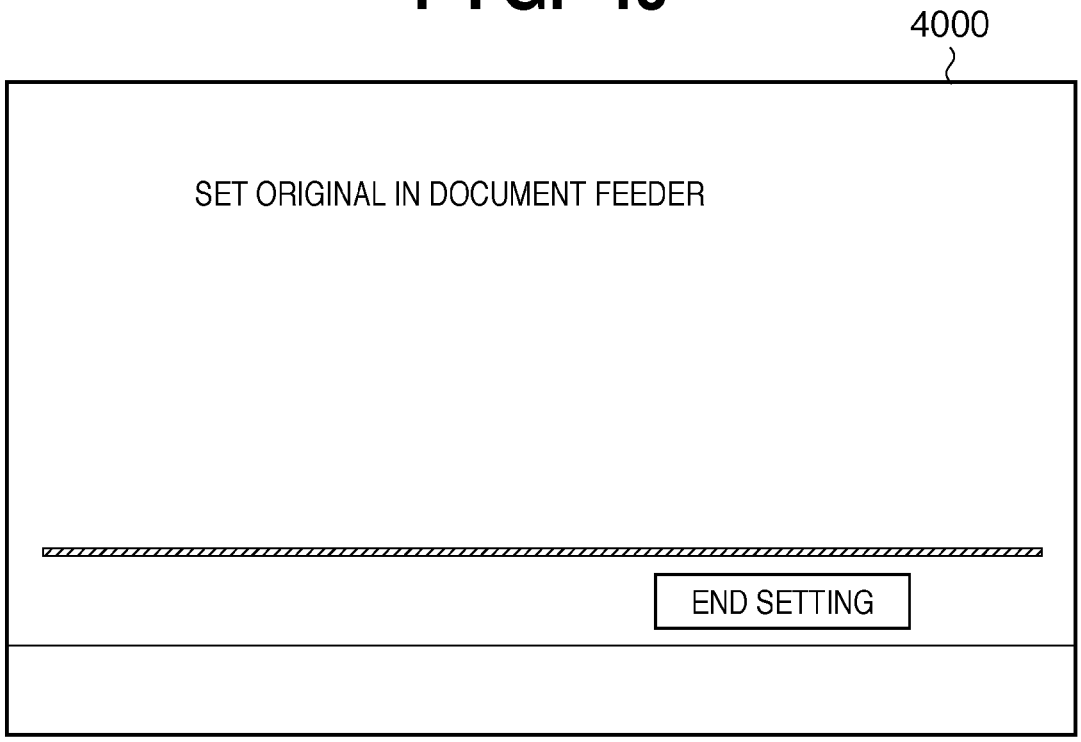
FIG. 40 shows an exemplary display screen displayed on the operation display unit.
Figure 41:
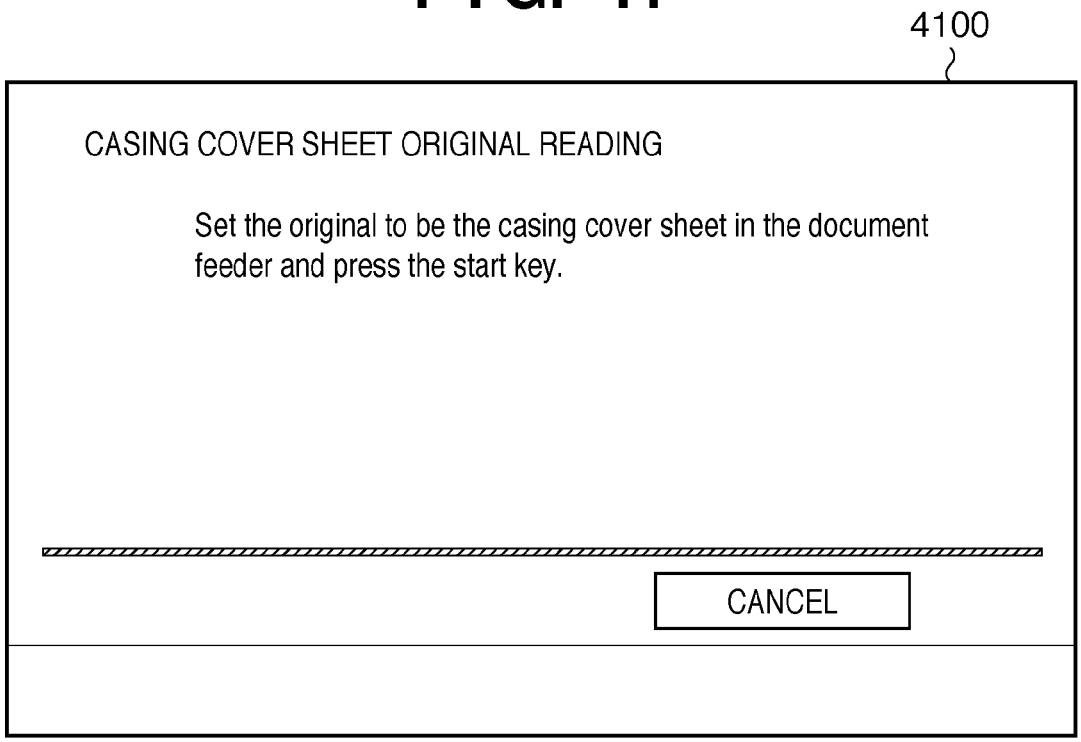
FIG. 41 shows an exemplary display screen displayed on the operation display unit.

In the case of determining affirmatively, processing proceeds to step S1009 in which the CPU 801 causes a display screen 3800 shown in FIG. 38 to be displayed, which shows the user information regarding possible bundle thicknesses for bookbinding. It should be noted that the bundle thickness information displayed in the display screens 3700 and 3800 may show an estimated value of the possible number of sheets in a bundle calculated using sheet thickness information for each inner sheet to be used and a bundle thickness calculated by the bundle thickness calculation control unit 811.

Then, in step S1010 the CPU 801 determines whether the cover sheet feeding source is the inserter. If the inserter has been selected as the sheet feeding stage, processing proceeds to step S1011 in which the CPU 801 sets "Inserter Mode" as the bookbinding mode performed when the inserter is the cover sheet feeding source. Thereafter, in step S1012 the CPU 801 prompts the user to set originals in the document feeder 100, after which binding mode setting ends.

On the other hand, if the cover sheet feeding source is not the inserter in step S1010, in step S1013 the CPU 801 sets the bookbinding mode to an original reading mode. Then, in step S1014 the CPU 801 causes a display screen 3900 shown in FIG. 39 to be displayed, receives user input, and determines whether the original reading mode is a normal reading mode or a cover sheet reading mode. This determination is performed in order to determine whether the casing cover sheet original and the inner sheet originals are separate. Accordingly, in the display screen 3900, "Cover Sheet Mode" is selected if the originals are separate, and "Normal Mode" is selected if the originals of the front/back cover sheets and the inner sheets are in the same bundle.

If "Normal Mode" is selected, processing proceeds to step S1015 in which the CPU 801 sets the original reading mode to the normal mode. Then, in step S1012 the CPU 801 causes the operation display unit 600 to display a display screen 4000 shown in FIG. 40, and prompts the user to set originals in the document feeder 100, after which bookbinding mode setting ends.

On the other hand, if "Cover Sheet Mode" is selected, processing proceeds to step S1016 in which the CPU 801 sets the original reading mode to the cover sheet mode. Then, in step S1017 the CPU 801 causes a display screen 4100 shown in FIG. 41 to be displayed, and prompts the user to set an original to be the casing cover sheet in the document feeder 100 and press the start key 602. When the start key 602 is pressed, in step S1018 the CPU 801 causes reading of the cover sheet original to be started.

Figure 42:
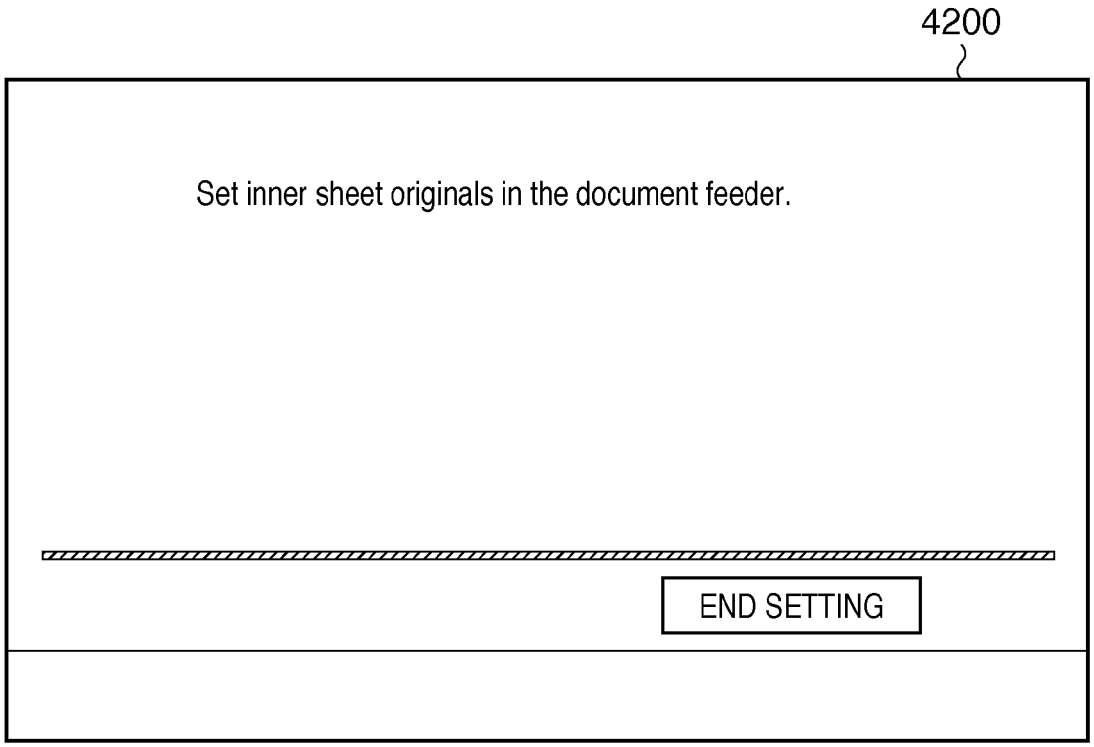
FIG. 42 shows an exemplary display screen displayed on the operation display unit.
Figure 43:
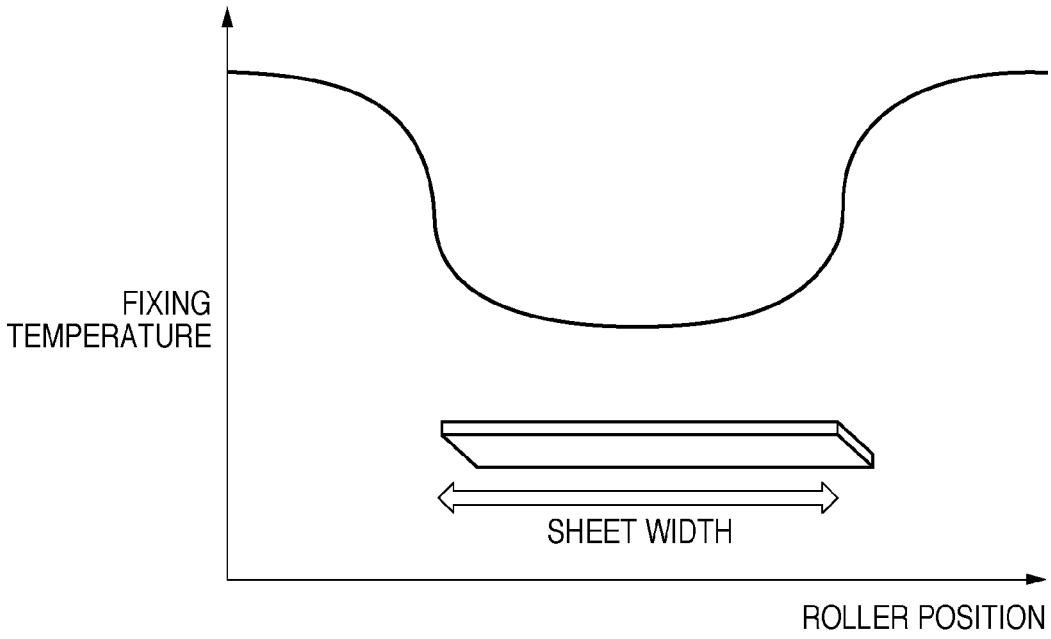
FIG. 43 is a diagram showing a fixing temperature distribution after recording sheet (paper) feeding.
Figure 44:
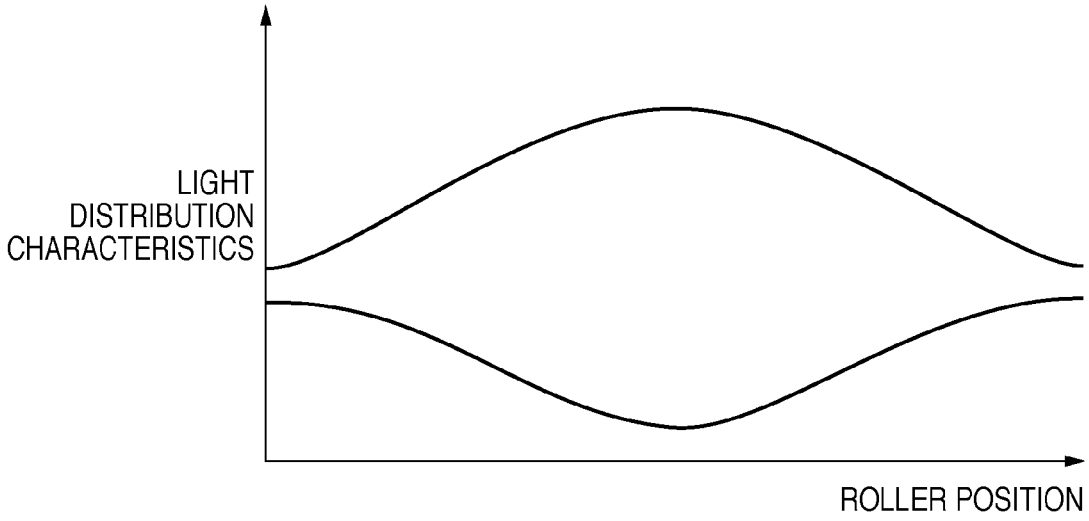
FIG. 44 is a diagram for illustrating the light distribution characteristics of a fixing heater.
Figure 45:
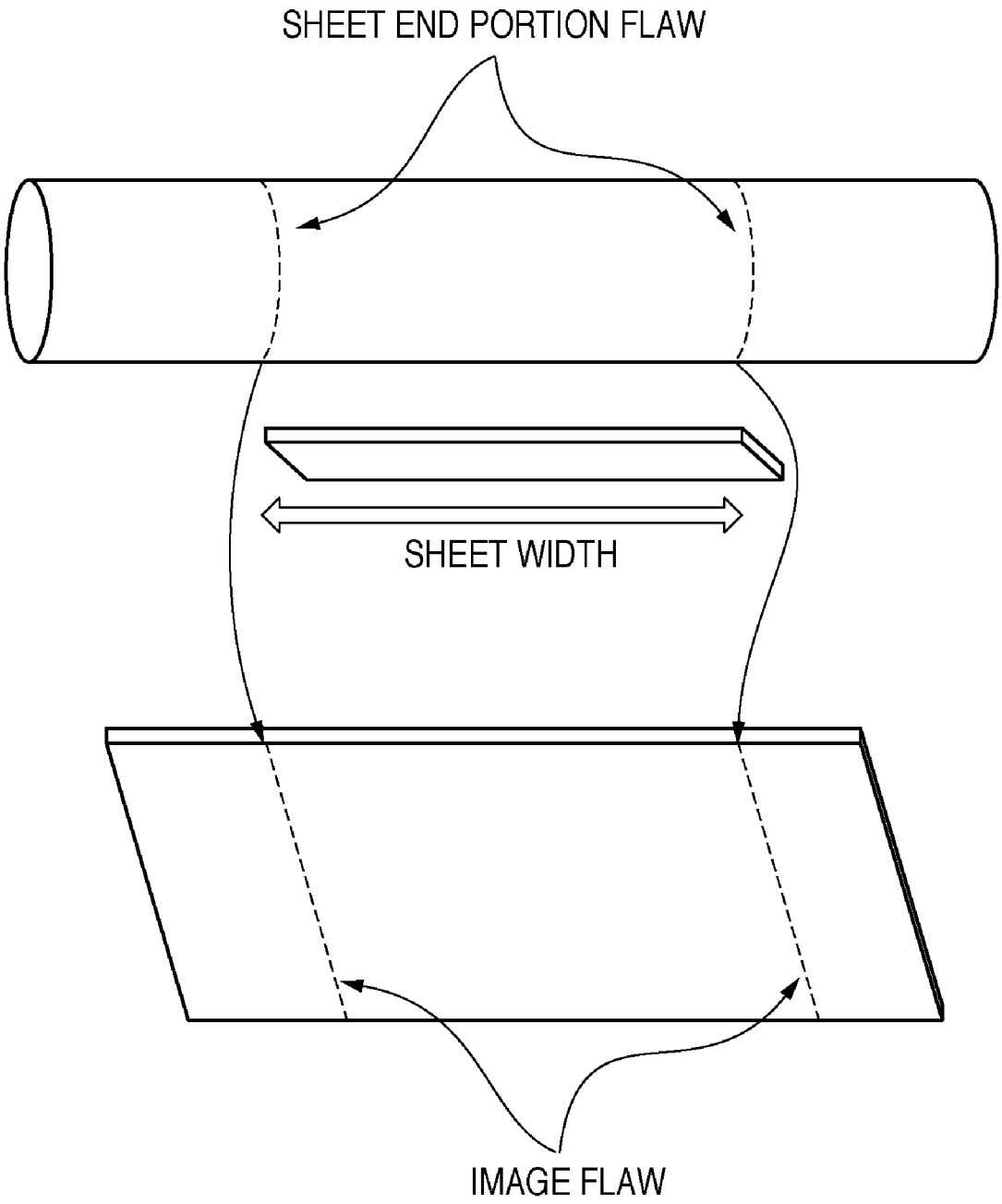
FIG. 45 is a diagram showing a condition in which flaws appear at end portions of paper.
Figure 46:
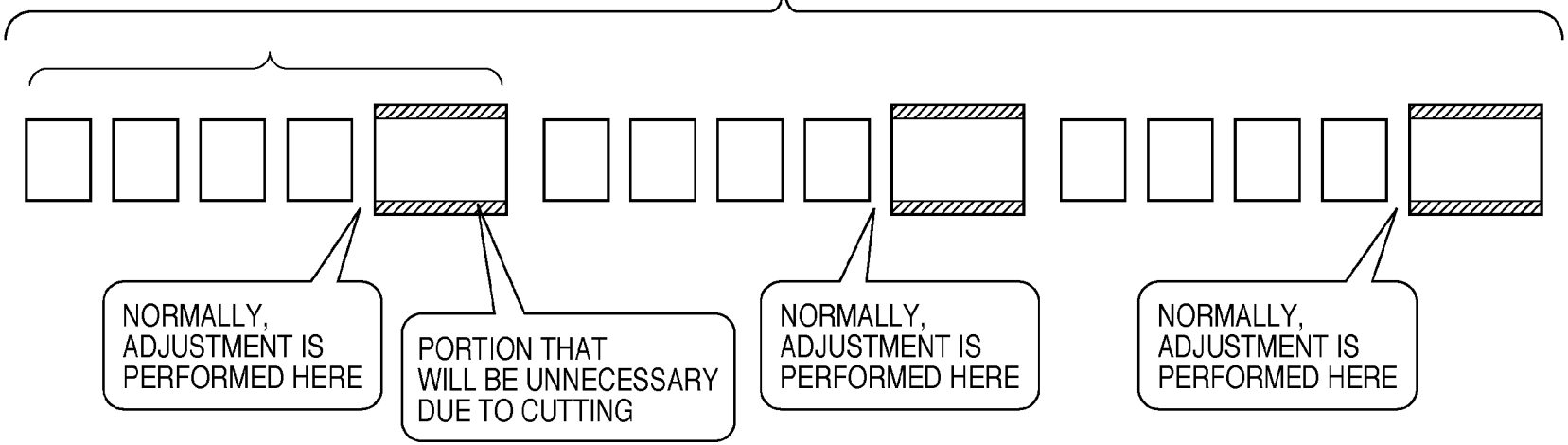
FIG. 46 is a diagram showing timings at which fixing adjustment is performed in a job that utilizes different paper sizes.

When reading of the cover sheet original has been completed, in step S1019 the CPU 801 causes a display screen 4200 shown in FIG. 42 to be displayed, and prompts the user to set inner sheet originals in the document feeder 100, after which bookbinding mode setting ends.

Print Processing

Figure 49:
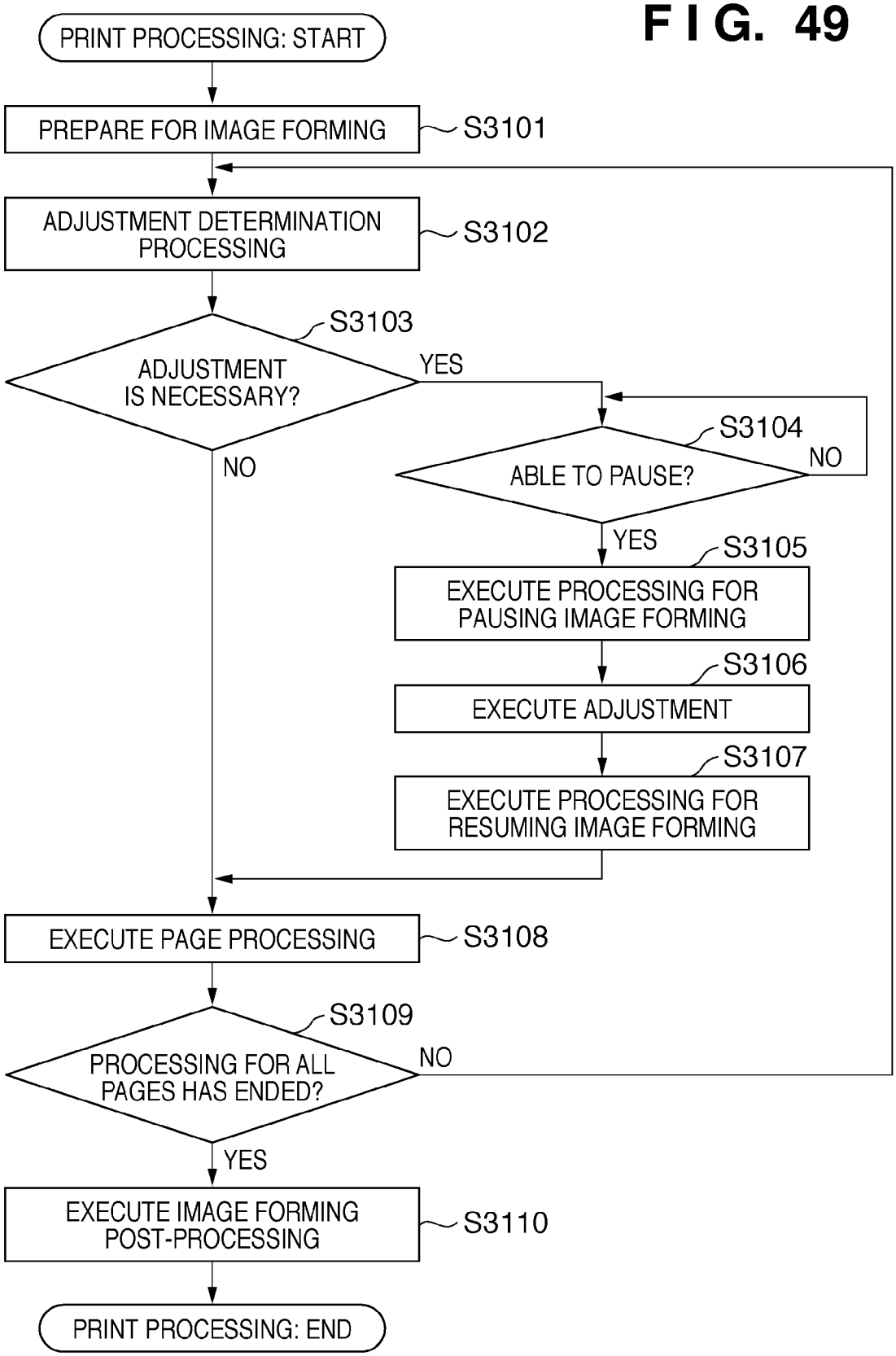
FIG. 49 is a flowchart showing a processing procedure of print processing according to the first embodiment.

The following describes operations performed when executing print processing with reference to FIG. 49. FIG. 49 is a flowchart showing a processing procedure of print processing according to the first embodiment. Overall control of the processing described below is performed by the CPU 801. The print processing is started when the start key 602 shown in FIG. 29 is pressed.

In step S3101, the CPU 801 performs preparation for image forming. Next, in step S3102 the CPU 801 performs adjustment determination processing, which is described later, for determining whether it is necessary for adjustment processing to be executed for a page on which printing is to be performed next. In step S3103, the determination result of S3102 is checked, processing proceeds to step S3104 if it is necessary for adjustment processing to be performed, and processing proceeds to step S3108 if it is not necessary for adjustment processing to be performed.

In step S3104, the CPU 801 continues to execute predetermined processing until conditions for performing adjustment processing have been satisfied, and executes image forming pause processing in step S3150 when pausing is possible. Thereafter, in step S3106 the CPU 801 executes adjustment processing until a predetermined condition has been satisfied. When adjustment processing has ended, in step S3107 the CPU 801 executes image forming resume processing, and processing proceeds to step S3108.

After adjustment processing has ended, or if it is not necessary to execute adjustment processing, in step S3108 the CPU 801 executes page printing processing. Next, in step S3109 the CPU 801 determines whether processing for all pages has ended. If processing for all pages has not ended, processing returns to S3102, and the processing of S3102 to S3109 is repeated. On the other hand, if it has been determined in step S3109 that processing for all pages has ended, processing proceeds to step S3110 in which the CPU 801 performs image forming post-processing, and print processing ends.

Adjustment Determination Processing

Figure 50:
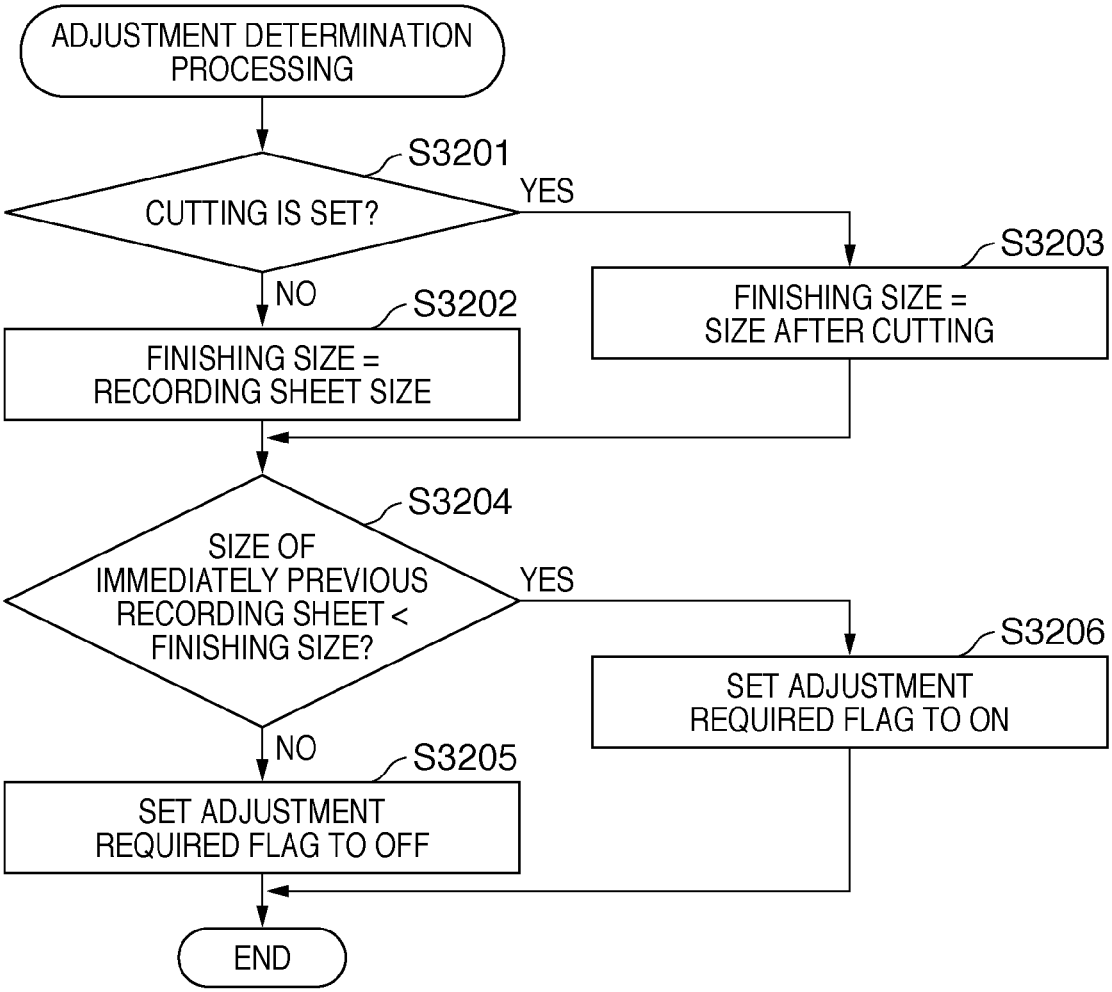
FIG. 50 is a flowchart showing a processing procedure of adjustment determination processing according to the first embodiment.

The following describes details of the adjustment determination processing performed in step S3102 of FIG. 49 with reference to FIG. 50. FIG. 50 is a flowchart showing a processing procedure of adjustment determination processing according to the first embodiment. Overall control of the processing described below is performed by the CPU 801. Also, adjustment determination processing is executed for each page in S3102 in the flowchart of FIG. 49.

First, in step S3201 the CPU 801 determines whether cutting has been set for a page for which determining is being performed. If cutting has not been set, processing proceeds to step S3202 in which the CPU 801 sets the recording sheet size as the finishing size for the corresponding page. On the other hand, if cutting has been set in S3201, processing proceeds to step S3203 in which the CPU 801 sets the size after cutting as the finishing size. Through this processing, the ultimate size of the product is set as the finishing size. Here, the CPU 801 is an example of a size specification unit that specifies the size of a printing material on which an image is to be formed.

Next, in step S3204 the CPU 801 determines whether the finishing size of the corresponding page is greater than the immediately previous recording sheet size. If the finishing size is not greater than the immediately previous recording sheet size, processing proceeds to S3205 in which the CPU 801 sets an adjustment required flag to OFF. On the other hand, if the finishing size is greater than the immediately previous recording sheet size, in step S3206 the CPU 801 sets the adjustment required flag to ON. Here, the CPU 801 is an example of an adjustment determination unit that determines whether it is necessary to execute adjustment processing for maintaining image quality, with use of a specified printing material size and the size of a printing material on which an image was formed immediately previously.

Performing such control enables a determination to be made regarding whether to execute adjustment processing or flaw removal on the fixing unit 117 (rather than automatically executing the adjustment processing, roller temperature adjustment or flaw removal automatically every time a page is printed), by comparing the finishing size of the page on which printing is to be performed next and the size of recording sheets that passed through immediately previously. In other words, the image forming apparatus of the present embodiment enables suppression of a drop in productivity by preventing the unnecessary performance of adjustment processing at every page.

According to the present embodiment, it is possible to prevent unnecessary adjustment processing and flaw removal when performing printing on both small recording sheets and large recording sheets, thereby enabling maintenance of image quality in products while suppressing a drop in productivity. This enables a more user-friendly image forming apparatus to be provided.

Second Embodiment

Figure 51:
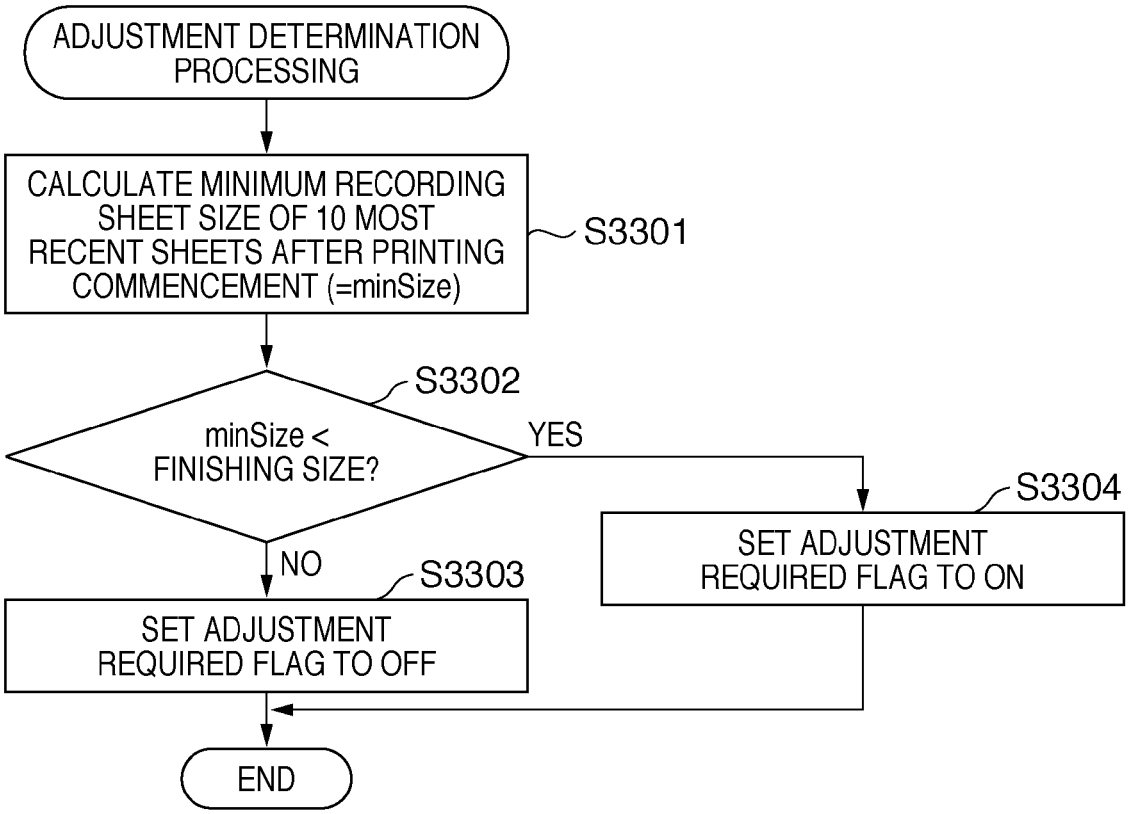
FIG. 51 is a flowchart showing a processing procedure of adjustment determination processing according to a second embodiment.

The following describes a second embodiment with reference to FIG. 51. The following describes only technical aspects that are different from the first embodiment. FIG. 51 is a flowchart showing a processing procedure of adjustment determination processing according to the second embodiment. Overall control of the processing described below is performed by the CPU 801.

First, in step S3301 the CPU 801 calculates the minimum recording sheet size among the recording sheet sizes of the ten immediately previous sheets after the printing operation has started. Here, "ten" is merely an example of the number of most recent sheets to be used in the calculation, and it is sufficient to use a predetermined number of sheets that is large enough for there to be an influence on subsequent recording sheets when the predetermined number of recording sheets have been fed.

Then, in step S3302 the CPU 801 determines whether the finishing size is greater than the minimum recording sheet size calculated in S3301. If the finishing size is not greater than the minimum recording sheet size, processing proceeds to step S3303 in which the CPU 801 sets the adjustment required flag to OFF. On the other hand, if the finishing size is greater than the minimum recording sheet size, processing proceeds to step S3304 in which the CPU 801 sets the adjustment required flag to ON.

Performing such control enables a determination to be made regarding whether to perform adjustment processing or flaw removal according to a relationship between the finishing size and the size of a certain number of immediately previous pages that may have an influence on the page on which printing is to be performed next.

Also, the execution of adjustment determination processing in the first embodiment and the second embodiment may be switched according to the user's case-bound product creation flow.

The present invention allows an image forming apparatus to be provided such that when, for example, image forming is to be successively performed on recording sheets having different sizes, it suitably executes adjustment processing on a fixing apparatus or the like used in image forming, and maintains image quality in addition to suppressing a drop in productivity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-196849 filed on Jul. 30, 2008, which is hereby incorporated by reference herein in its entirety.

What is claimed is:

1. An image forming apparatus comprising:

a transfer unit that transfers a toner image onto a printing material;

a fixing unit that fixes the toner image that was transferred by the transfer unit onto the printing material;

a cutting unit that executes cutting processing on the printing material onto which the toner image was fixed by the fixing unit;

a determination unit that determines whether adjustment processing is to be executed on the fixing unit, based on a post-cutting size of a first printing material to be cut by the cutting unit and the size of a second printing material on which an image was formed immediately before the first printing material; and an adjustment unit that executes the adjustment processing on the fixing unit if the determination unit has determined that the adjustment processing is to be executed on the fixing unit.

2. The image forming apparatus according to claim 1, wherein the adjustment processing is processing in which the temperature of the fixing unit is made uniform.

3. The image forming apparatus according to claim 1, wherein the adjustment processing is processing in which flaws on a surface of the fixing unit are removed.

4. The image forming apparatus according to claim 1, wherein the determination unit determines whether the adjustment processing has to be executed for each printing material on which an image is to be formed.

5. A control method for an image forming apparatus that includes a transfer unit that transfers a toner image onto a printing material, a fixing unit that fixes the toner image that was transferred by the transfer unit onto the printing material, and a cutting unit that executes cutting processing on the printing material onto which the toner image was fixed by the fixing unit, the control method comprising:

determining whether adjustment processing is to be executed on the fixing unit, based on a post-cutting size of a first printing material to be cut by the cutting unit and the size of a second printing material on which an image was formed immediately before the first printing material; and executing the adjustment processing on the fixing unit if it has been determined in the determining step that the adjustment processing is to be executed on the fixing unit.

* * * * *